US010202797B1

(12) United States Patent
Header

(10) Patent No.: US 10,202,797 B1
(45) Date of Patent: Feb. 12, 2019

(54) INFILL PANEL AND OPERABLE FENESTRATION FRAME ADJUSTMENT DEVICE

(71) Applicant: Gregory A Header, Richland, PA (US)

(72) Inventor: Gregory A Header, Richland, PA (US)

( * ) Notice: Subject to any disclaimer, the term of this patent is extended or adjusted under 35 U.S.C. 154(b) by 0 days.

(21) Appl. No.: 15/844,326

(22) Filed: Dec. 15, 2017

(51) Int. Cl.
*E06B 3/54* (2006.01)
*E06B 3/72* (2006.01)
*E06B 3/26* (2006.01)

(52) U.S. Cl.
CPC ..... *E06B 3/5409* (2013.01); *E06B 3/26* (2013.01); *E06B 3/72* (2013.01)

(58) Field of Classification Search
CPC ..... E06B 3/5409; E06B 3/26; E06B 3/72
USPC ... 52/204.5, 204.53, 204.62, 204.64, 204.65, 52/204.72, 204.1
See application file for complete search history.

(56) References Cited

U.S. PATENT DOCUMENTS 1,138,499 A 5/1915 Murnane
1,995,819 A 3/1935 Rogers
2,460,391 A 6/1944 Miller
2,442,147 A * 5/1948 Recklitis ..... E05D 13/08 49/418
2,518,969 A 8/1950 Woodard
2,610,369 A 9/1952 Huizenga
2,707,536 A 5/1955 Wooten
3,404,501 A 10/1968 Von Wedel
3,413,761 A 12/1968 Proni
3,780,472 A 12/1973 Biebuyck
3,992,833 A 11/1976 Hulinsky
4,397,124 A 8/1983 Redman
4,671,016 A 6/1987 Boeckx
4,763,453 A 8/1988 Hogan, Jr.
4,920,717 A * 5/1990 Hooper, Jr. ..... E04F 11/1851 52/204.597

(Continued)

FOREIGN PATENT DOCUMENTS

AU 2004202244 A1 3/2005
DE 1282282 B 11/1968

(Continued)

OTHER PUBLICATIONS

Who Gets the Blame when an Expensive Show-Window is Broken? Advertisement from the Zouri Drawn Metals company, Chicago Heights, IL, The American Contractor Magazine, p. 95, Apr. 15, 1916.

(Continued)

*Primary Examiner* — Brent W Herring
(74) *Attorney, Agent, or Firm* — Stone Creek Services LLC; Alan M Flum

(57) ABSTRACT

A system for adjusting infill panel or operable fenestration frame in an operable fenestration. The system can include a setting block adjustment device and an operable fenestration frame such as a door rail or window sash with glass, acrylic, polycarbonate or other infill material. The setting block adjustment device can include a lug, a threaded fastener, a setting block support plate, and a setting block. The lug is slidably captive within a groove in an outer face of the operable fenestration. The threaded fastener engages a threaded aperture within a blind hole in the lug. The fastener end engages the setting block support plate and setting block to adjust the infill panel.

20 Claims, 31 Drawing Sheets

(56) References Cited

U.S. PATENT DOCUMENTS

| | | | | |
|---|---|---|---|---|
| 5,483,775 | A | 1/1996 | Redman | |
| 6,230,457 | B1 * | 5/2001 | Brautigam | E05C 9/02 292/139 |
| 6,912,818 | B2 | 7/2005 | Sprague | |
| 7,063,305 | B2 | 6/2006 | Forestan et al. | |
| 7,584,588 | B2 | 9/2009 | Kim | |
| 7,963,077 | B2 | 6/2011 | Lin | |
| 8,925,258 | B1 * | 1/2015 | Header | E05D 15/00 16/90 |
| 9,598,893 | B2 | 3/2017 | Vandervelden et al. | |
| 2006/0070318 | A1 | 4/2006 | Chen et al. | |
| 2015/0267460 | A1 * | 9/2015 | Header | E06B 1/524 52/204.5 |

FOREIGN PATENT DOCUMENTS

| | | | |
|---|---|---|---|
| DE | 1916449 | A1 | 10/1970 |
| DE | 7430716 | U | 1/1976 |
| DE | 2558018 | A1 | 6/1977 |
| DE | 2832381 | A1 | 2/1980 |
| DE | 8104636 | U1 | 2/1982 |
| DE | 3217244 | A1 | 11/1983 |
| DE | 3234525 | A1 | 3/1984 |
| DE | 4006682 | A1 | 9/1991 |
| DE | 9109232 | U1 | 10/1991 |
| DE | 102016118140 | A1 | 3/2017 |
| EP | 403439 | A1 | 12/1990 |
| EP | 638702 | B1 | 2/1995 |
| EP | 866909 | B1 | 4/1998 |
| FR | 2544373 | A1 | 10/1984 |
| GB | 1427173 | A | 3/1976 |
| GB | 2176828 | B | 5/1987 |
| GB | 2365480 | A | 5/2001 |
| GB | 2473841 | A | 9/2009 |
| JP | 06079987 | U | 11/1994 |
| JP | 2004218202 | A | 8/2004 |
| WO | 2015145373 | A1 | 10/2015 |

OTHER PUBLICATIONS

Offset Pivot Doors with Floor Closers: Installation Instructions, Jan. 2004, Kawneer Company, Inc., Norcross, Georgia.

Versa-Therm Installation Instructions, May 1990, Tubelite Inc., Walker, Michigan.

Series 400 CentreGlazeTM Framing Single Glazed 102 mm, Nov. 2013, Architectural Window Systems, Pty Ltd., Australia.

Capral Product Catalog, Glazing Details: Doors 249 Superfine, p. 5-39, Document No. ATDM001.01, Jun. 2000, Capral Aluminum Limited, Australia.

Cardinal Commercial Products, Entrance Door Installation Instructions, p. 17, Jun. 2013, Cardinal Commercial Products, Louisville, Kentucky.

AD-375 Thermal Door Installation and Glazing Manual, pp. 17 and 21, May 2013, Old Castle Building Envelope, Battle Ground, Washington.

Glazing Recommendations Heavy Glass Lites in Doors, Aug. 2010, Stiles Custom Metal Inc., Ceres, California.

* cited by examiner

INFILL PANEL AND OPERABLE FENESTRATION FRAME ADJUSTMENT DEVICE

BACKGROUND

This disclosure relates to operable fenestrations with infill panels.

Operable fenestrations, such as doors, windows, and folding glass walls are often hinged. Hinged operable fenestrations can include infill panels such as single-pane glass panels or multi-pane insulated glass panels. Glazing stops can secure an infill panel to an operable fenestration frame. Examples of operable fenestration frames include door rails and window sashes. The glazing stops are attached to the operable fenestration frame and surround a lower portion of the outer faces of the infill panel. Setting blocks can be positioned along various portions of the operable fenestration frame to cushion and shock-isolate the perimeter edge of the infill panel from the operable fenestration frame.

One conventional use of setting blocks for doors and other hinged operable fenestrations is cross-blocking. Cross-blocking positions a first pair of setting blocks on adjacent sides of the upper corner of the fenestration frame distal from the hinges, and a second pair of setting blocks on adjacent sides of the lower corner of the fenestration frame proximate to the hinges. Hinged fenestrations, such glass doors, can rotate into the fenestration opening over time because of gravity. For example, for a left hinged door, the door can rotate clockwise with the top of the door moving away from the upper hinge and the bottom of the door moving toward the bottom hinge. A hinged fenestration's tendency to sag or rotate can particularly be a problem for doors or windows with massive glass infill. Cross-blocking can help to counteract this effect by pressuring the fenestration frame in the opposite direction. For example, in a left-side hinged door, placing setting blocks in the lower left-hand corner (i.e., bottom hinge side), and upper right-hand corner shifts the weight away from the vertical fenestration frame member distal from the hinge side of the door and counteracts the door's tendency to rotate.

SUMMARY

While cross-blocking is helpful, an operable fenestration, such as a glass door or folding window wall, over time can still settle and rotate. In addition, the operable fenestration frame may shift and no-longer maintain a perpendicular relationship between adjacent operable fenestration frame members. The inventor originally assumed, according to conventional wisdom in the fenestration industry, that the sagging came from the hinges. The inventor discovered that while the hinges contribute to some of the sagging, a major contribution of the sagging after cross-blocking comes from gaps formed between the setting block, glass infill panel, and frame during installation. Additional sagging can come from deformation of the settling blocks overtime because they are under compression. To solve these problems, the inventor developed a system for adjusting an infill panel of an operable fenestration and for adjusting the operable fenestration frame of the operable fenestration. The system can allow the infill panel to be adjusted while the operable fenestration is in service.

The system includes a setting block adjustment device and an operable fenestration frame. The setting block adjustment device includes a lug, a threaded fastener, and a setting block assembly. The operable fenestration includes a groove positioned lengthwise along the outer face of the operable fenestration frame opposite the inner face that secures the infill panel. The setting block assembly includes a setting block and can optionally include a setting block support plate. The threaded fastener includes a head, a threaded body extending from the threaded head, and a fastener end terminating the threaded body opposite the head. The lug includes a threaded aperture and can optionally include a blind hole with the threaded aperture through the bottom surface of the blind hole. With the head of the threaded fastener positioned within the blind hole, the threaded body threadedly engages the threaded aperture. The fastener non-threadedly engages the setting block assembly where it typically non-threadedly engages a setting block adjustment plate. Optionally, the fastener can non-threadedly engage an integral setting block and setting block adjustment plate. The setting block rests against a portion of the perimeter edge the infill panel. Adjusting the head of the threaded fastener creates a corresponding movement of the setting block as the threaded fastener engages the setting block support plate.

One of the inventor's discoveries was to create a setting block adjustment device that could derive its strength and structural integrity from the lug combined with operable fenestration frame. The lug being slidably captive within a groove positioned lengthwise along the outer face of the operable fenestration frame.

The inventor's system for adjusting an infill panel of an operable fenestration has these advantages and unexpected results.

First, the setting block adjustment system derives its strength from a combination of the lug and distributed force across the groove within the operable fenestration frame. This makes the setting block adjustment system suitable for a wide range of frame types including aluminum, wood, vinyl, and fiberglass.

Second, because the lug is slidably captive, the strength of the setting block adjustment system does not depend on the tension capacity of the threaded fastener. The combination of lug, threaded fastener, and groove can be significantly stronger than the shear strength of threaded fastener itself.

Third, the setting block adjustment device can adjust the infill panel or operable fenestration frame while the operable fenestration is in place and in operation. The heads of the threaded fasteners can be easily accessed to adjust the threaded fasteners from within the grooves while the operable fenestration is hung on its hinges. Using a blind hole within the lug, the system can be designed so that the head of the threaded fastener stays within the blind hole during operation.

Fourth, the setting block adjustment device can be positioned anywhere along the operable fenestration frame without compromising the structural integrity of the operable fenestration frame. Damage is minimalized because the frame does not have to be milled or removing excess material which could potentially compromise the structural integrity of the frame.

Fifth, the setting block adjustment devices can be added, removed, or repositioned while the operable fenestration is mounted for operation. There is no need to remove the operable fenestration from its hinges.

Sixth, the inventor envisions using the setting block adjustment device in a wide variety of fenestrations. These include, for example, swing doors, folding doors, swing windows, folding windows, and folding glass walls, hung doors, and other operable fenestrations.

Seventh, while the lug need not be aligned over the infill panel, it can be aligned directly with the infill panel. Alignment of the infill panel and lug can potentially simplify the design of the setting block adjustment device.

This Summary introduces a selection of concepts in simplified form described in the Description. The Summary is not intended to identify essential features or limit the claimed subject matter.

DRAWINGS

DESCRIPTION

Figure 1:
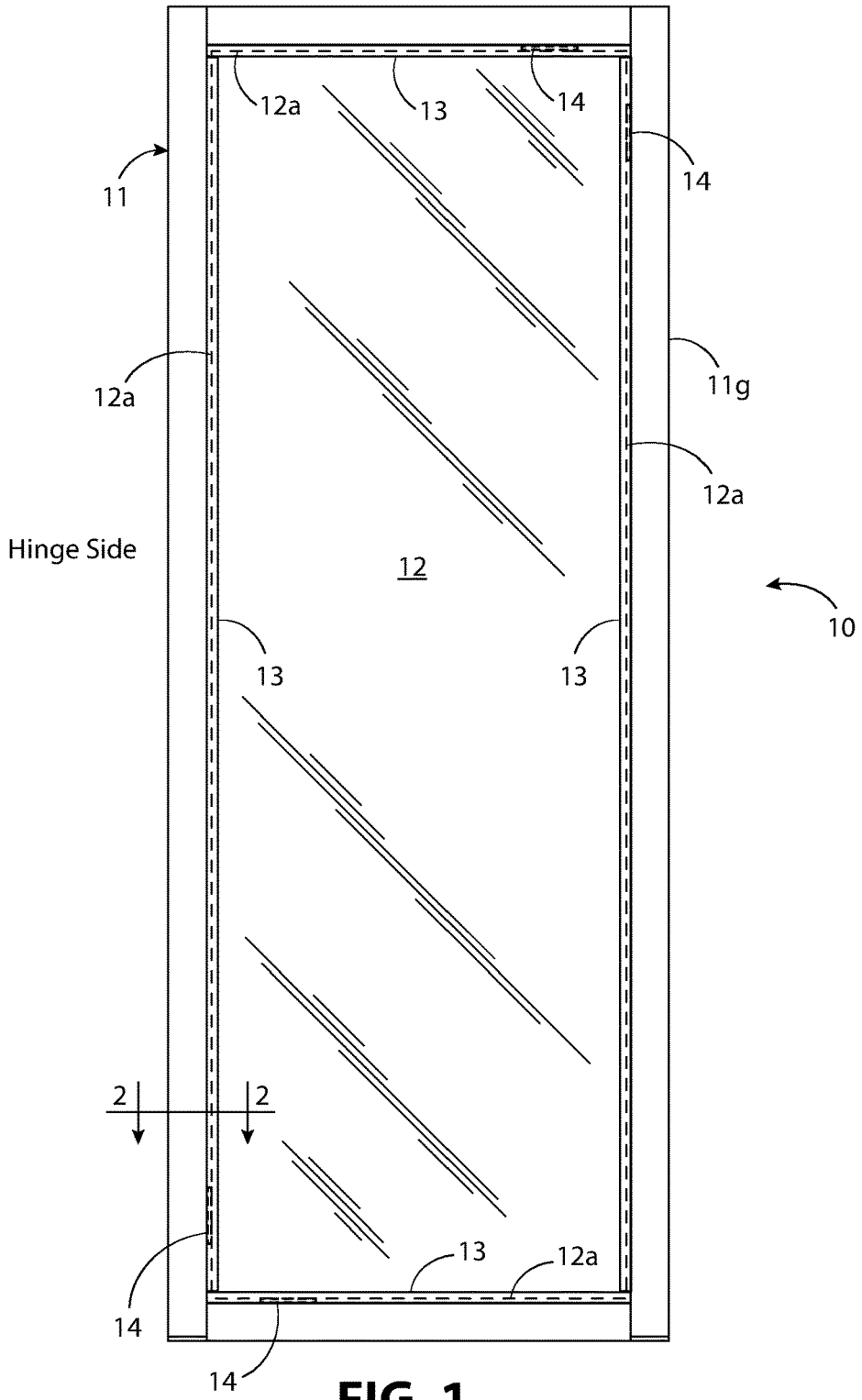
FIG. 1 PRIOR ART
FIG. 1 illustrates a front view of an operable fenestration in the prior art.

The terms "left," "right," "top, "bottom," "upper," "lower," "front," "back," and "side," are relative terms used throughout the to help the reader understand the figures. Unless otherwise indicated, these do not denote absolute direction or orientation and do not imply a preference. When describing the figures, the terms "top," "bottom," "front," "rear," and "side," are from the perspective of outside looking in. Specific dimensions should help the reader understand the scale and advantage of the disclosed material. Dimensions given are typical and the claimed invention is not limited to the recited dimensions. Referring to similarly named part with an ordinal prefix such as first, second, or third helps distinguish the parts from one another when referred to together. This implies no preference of one part over the other. Similarly, referring to examples using ordinal prefixes or as alternative examples, does such not infer any preference of one example over the other.

Throughout this description, examples may show a door or window. Within the meaning of this disclosure, in the examples of FIGS. 4-41, the term door or window can be used interchangeably. That is, a given figure can represent either a door or window without changing the implementation of the setting block adjustment system illustrated.

These terms are used throughout this disclosure and are defined here for clarity and convenience.

Fenestration: As defined in this disclosure, a fenestration is an opening in a surface of a building. For example, a door, window, fixed glass panel, openable partition, skylight, or curtain wall are all fenestrations.

Fenestration Frame: As defined in this disclosure, a fenestration frame surrounds and frames an infill panel. For example, a fenestration frame can include a rail surrounding a glass infill panel of a door or can include a sash surrounding a glass infill of a window. When the fenestration frame is openable or operable, it can be referred to as an operable fenestration frame; see the definition of operable fenestration frame below.

Frame: As defined in this disclosure, a frame is the enclosing structure of a fenestration that attaches to the surrounding building structure. For example, a frame can attach to the wall surrounding a window, door, or curtain wall. A frame can surround the roof opening that receives a skylight. A frame is distinguished from a fenestration frame defined above or an operate fenestration frame defined below.

Glazing Stop: As defined in this disclosure, a glazing stop includes a removable rigid member, or molding, with an optional cushioning material that holds an infill panel in the fenestration frame. The rigid member is typically wood, metal, plastic, or other rigid materials. The glazing stop can include gaskets or other cushioning material to buffer direct contact between the rigid member and the infill panel.

Infill: As defined in this disclosure, infill or infill panel refers to a panel such as glass, polycarbonate, acrylic, wood, or aluminum, or a combination of materials, surrounded by a fenestration frame or an operable fenestration frame. An insulating glass unit (IGU) is an example of an infill panel. An IGU can include two or more sealed (i.e., gas-tight) panes of glass, plastic, or other transparent material, separated by air, a vacuum, or an inert gas.

Operable Fenestration: As defined in this disclosure, an operable fenestration is a door, window or other fenestration panel that can be opened and closed.

Operable Fenestration Frame: As defined in this disclosure, an operable fenestration frame is the fenestration frame surrounding the infill panel in an operable fenestration. For example, a door rail or window sash surrounding a glass infill panel is an operable fenestration frame.

Setting Block: As defined in this disclosure, a setting block, or stop block, is a cushioning member placed between an infill panel and the fenestration frame or between an infill panel and the operable fenestration frame. Setting blocks are often rectangular and can be made of a material with elastic properties such as ethylene propylene diene monomer (EPDM), polychloroprene (i.e., neoprene), rubber, silicone, or other flexible materials suitable for supporting the weight of the infill panel and cushioning it from breakage when secured against the operable fenestration frame.

Figure 2:
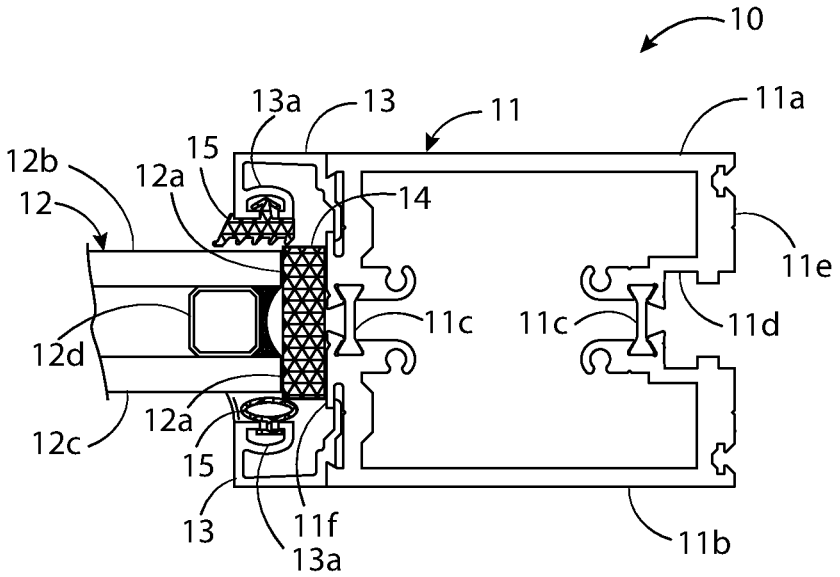
FIG. 2 PRIOR ART
FIG. 2 illustrates a section view of FIG. 1 in the prior art taken along section lines 2-2.
Figure 3:
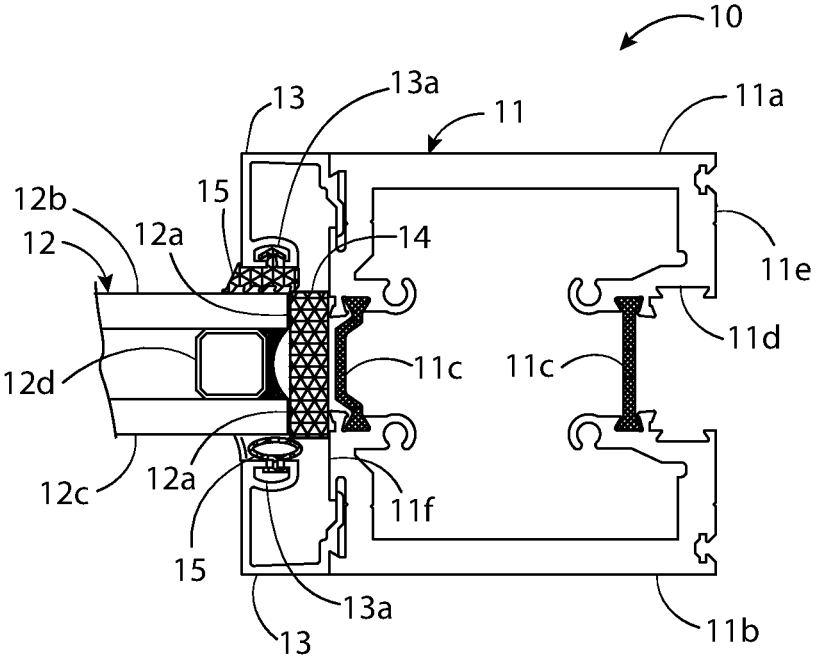
FIG. 3 PRIOR ART
FIG. 3 illustrates an alternative section view of an operable fenestration in the prior art.

The description that follows is made referring to figures, where like numerals refer to like elements throughout the several views. FIG. 1 illustrates an operable fenestration 10 in the prior art. The operable fenestration 10 illustrated is a door however it can represent window. FIG. 2 illustrates a section view of the operable fenestration 10 of FIG. 1 taken along section lines 2-2 in the prior art. FIG. 3 illustrates a section, taken at the same location as in FIG. 2, of a different example of an operable fenestration 10 in the prior art. Referring to FIGS. 1-3, the operable fenestration 10 includes an operable fenestration frame 11, and an infill panel 12. The infill panel 12 is secured to the frame by glazing stops 13 on either face of the infill panel 12. The bottom edge 12*a* of the infill panel 12 seats against the operable fenestration frame 11 by setting blocks 14. The setting blocks 14 cushion the infill panel 12 to help prevent breakage. Referring to FIG. 1, the setting blocks 14 and the bottom edge 12*a* of the infill panel 12 are shown in broken lines to indicate that they are hidden from view behind the glazing stops 13.

Referring to FIGS. 2 and 3, the operable fenestration frame 11 include a first fenestration frame sub-member 11*a* and a second fenestration frame sub-member 11*b* separated by thermal struts 11*c*. The thermal struts 11*c* thermally isolate the first fenestration frame sub-member 11*a* from the second fenestration frame sub-member 11*b*. The operable fenestration frame 11 includes a groove 11*d* positioned lengthwise along the outer face 11*e* of the operable fenestration frame 11 opposite the inner surface 11*f* that receives the infill panel 12. The groove is an American-style Euro-groove. American-style Euro-grooves are typical used to secure American-style locksets, hardware, or hinges. In these examples, the infill panel 12 is illustrated as IGU with a pair of glass panels 12*b*, 12*c* separated by a spacer 12*d*. The infill panel 12 is held in place by a pair of glazing stops 13. Each of the glazing stops 13 is shown joined to a glazing gasket 15 that cushions the infill panel 12 from the glazing stop 13. In these examples, the glazing gasket 15 snaps into a slot 13*a* in the glazing stop 13.

Referring to FIG. 1, a pair of setting blocks 14 are positioned near the upper right-hand corner of the operable fenestration 10 and another pair of setting blocks 14 are positioned in the lower left-hand corner of the operable fenestration 10. This is cross-blocking. Hinged fenestrations, such as the door in FIG. 1, will rotate into the fenestration opening over time because of gravity. For example, for a left hinged door, as illustrated in FIG. 1, the door can rotate clockwise. This can particularly be a problem for doors or windows with heavy glass infill. Cross-blocking can help to counteract this effect by pressuring the fenestration frame in the opposite direction. In FIG. 1, placing the setting blocks 14 in the lower left-hand corner (i.e. bottom hinge side) and upper right-hand corner shifts the weight away from the vertical fenestration frame member 11*g* distal to the hinge side and counteract the door's tendency to rotate into the door frame.

Figure 4:
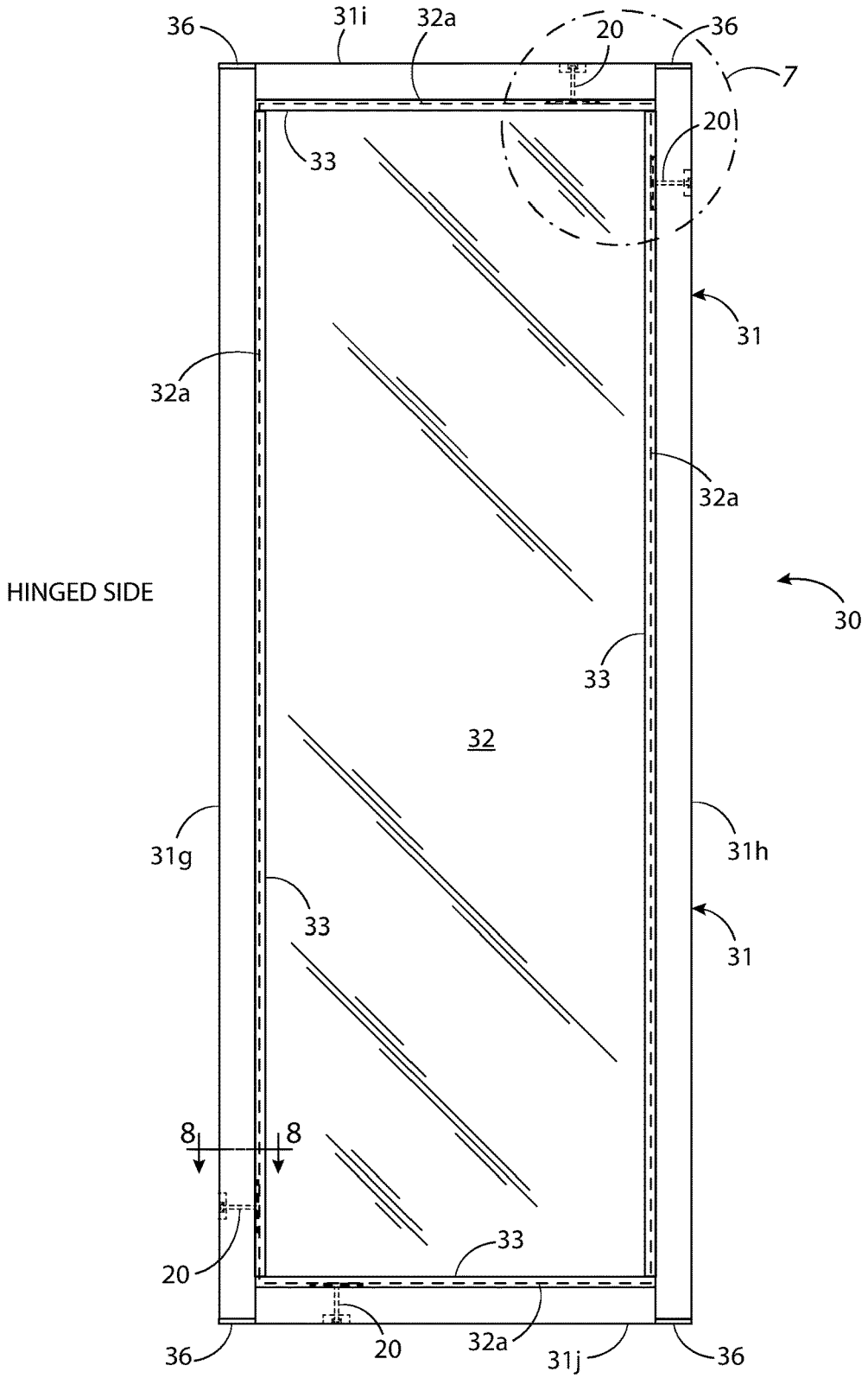
FIG. 4 illustrates a front view of a typical fenestration utilizing four setting block adjustment devices in a cross-blocking arrangement.
Figure 5:
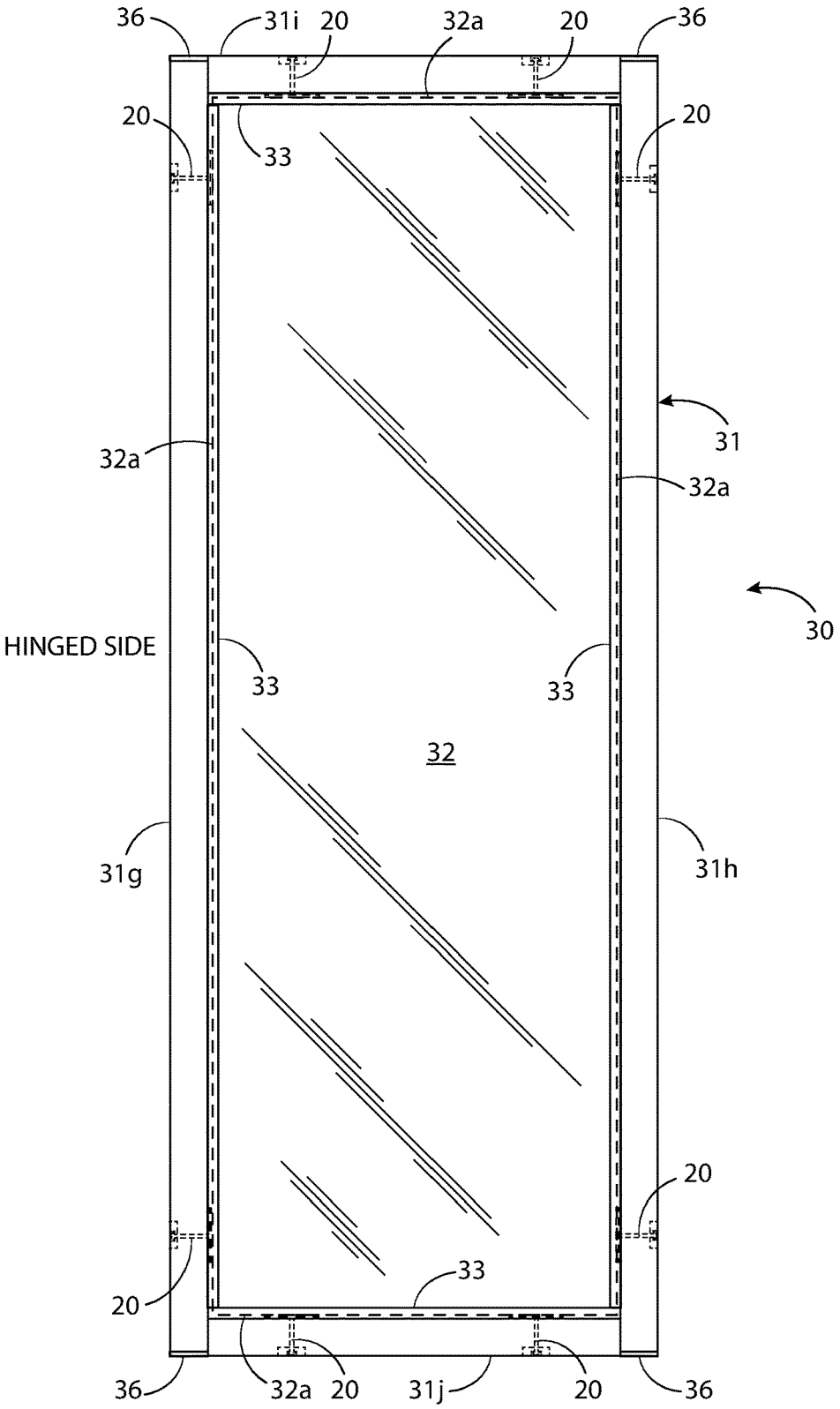
FIG. 5 illustrates a front view of a typical fenestration utilizing eight setting block adjustment devices.
Figure 6:
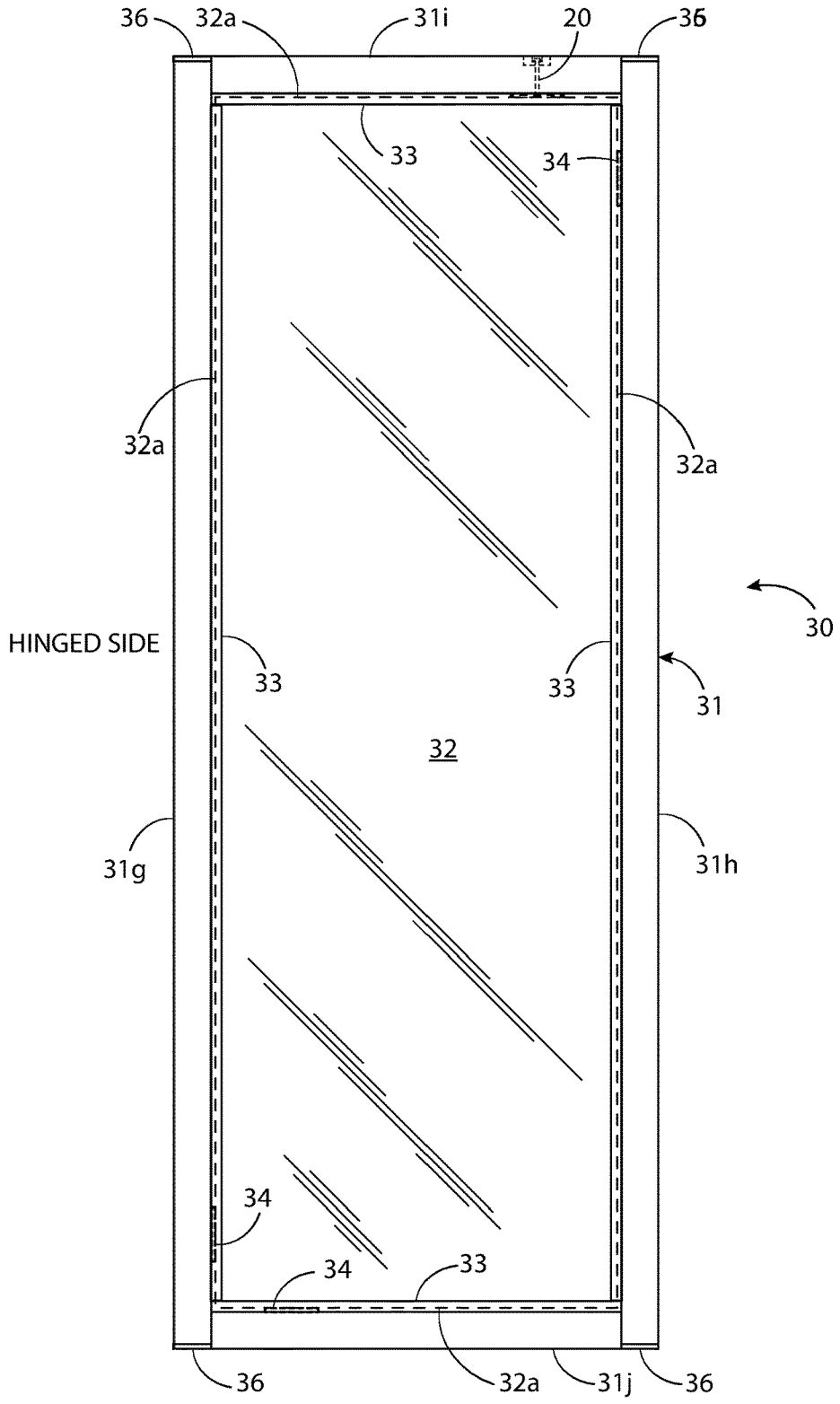
FIG. 6 illustrates a front view of a typical fenestration utilizing a setting block adjustment device combined with conventional setting blocks.
Figure 7:
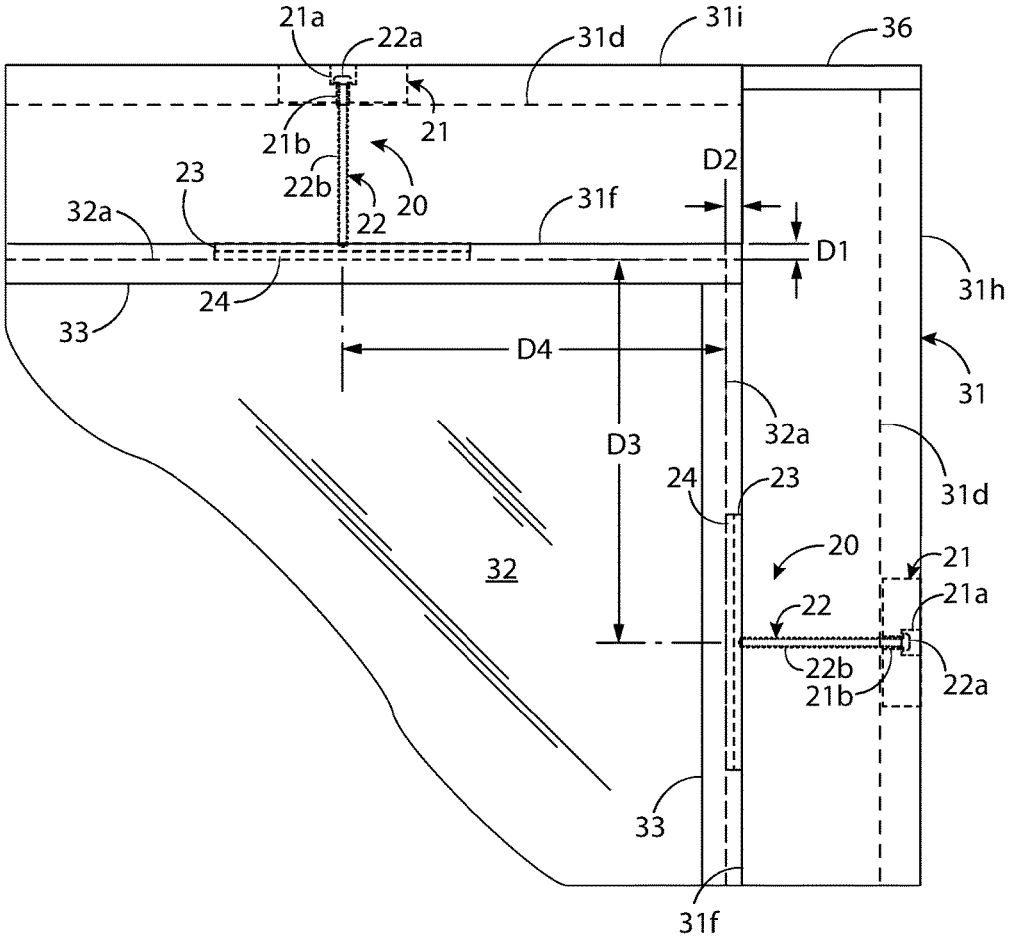
FIG. 7 illustrates a portion of the fenestration of FIG. 4 taken along detail 7; the portion is enlarged for magnification purposes.

While cross-blocking is helpful, over time, the door can still settle and rotate into the door frame. In addition, the operable fenestration frame 11 of FIGS. 1-3 may shift and no-longer maintain a perpendicular relationship between adjacent operable fenestration frame members. In addition, as described in the Summary, the infill panel may shift or settle because of gaps between the setting blocks, glass, and operable fenestration frame formed during assembly. To solve these problems, the inventor developed a system for adjusting an infill panel of an operable fenestration. The system can also adjust the operable fenestration frame itself. The system includes a setting block adjustment device a grooved operable fenestration frame. These will be discussed throughout the rest of this disclosure. FIGS. 4-6 illustrate typical configurations of the system where the setting block adjustment device 20 applied to an operable fenestration 30 with FIG. 7 showing a corner portion of FIG. 4 enlarged to show greater detail. FIG. 4 illustrates how the inventor solved the challenges associated with traditional cross-block methods discussed in the preceding paragraph, using setting block adjustment devices 20 combined with operable fenestration frames 31. The remainder of the figures show the system for adjusting an infill panel of an operable fenestration with the setting block adjustment device 20 adapted for different operable fenestrations and various environments. The common features and structure of all illustrated configurations are described together for clarity referring to individual sets of figures given as needed.

FIGS. 4-7 show the setting block adjustment devices 20 in relation to various components of the operable fenestration 30. These include an operable fenestration frame 31, an infill panel 32, and glazing stops 33. The perimeter edge 32*a* of the infill panel 32 is shown in dashed lines to indicate it is hidden beneath the glazing stops 33. In FIGS. 4-6, the operable fenestration frame 31 includes vertical fenestration frame members 31*g*, 31*h* and horizontal fenestration frame members 31*i*, 31*j*. Referring to FIG. 4, two pairs of the setting block adjustment devices 20 are used in place of the setting blocks 14 of FIG. 1. As the door or window settles over time, or as the door or window operable fenestration frame goes out of true, the setting block adjustment devices 20 can be adjusted to compensate. One advantage of the setting block adjustment device 20 is that it is not just limited to cross-blocking. One or more setting block adjustment devices 20 can be configured anywhere along the perimeter of the operable fenestration 30. For example, in FIG. 5 setting block adjustment devices 20 are positioned proximate to each corner of the operable fenestration 30. FIG. 6 illustrates how a setting block adjustment device 20 can replace one of the setting blocks 34 in a conventional cross-blocking configuration. The operable fenestration frame 31 of FIGS. 4-7 are shown having butt corner joints terminated with cover plates 36. However, the setting block adjustment device 20 can work with both mitered corner joints and butt corner joints.

Figure 8:
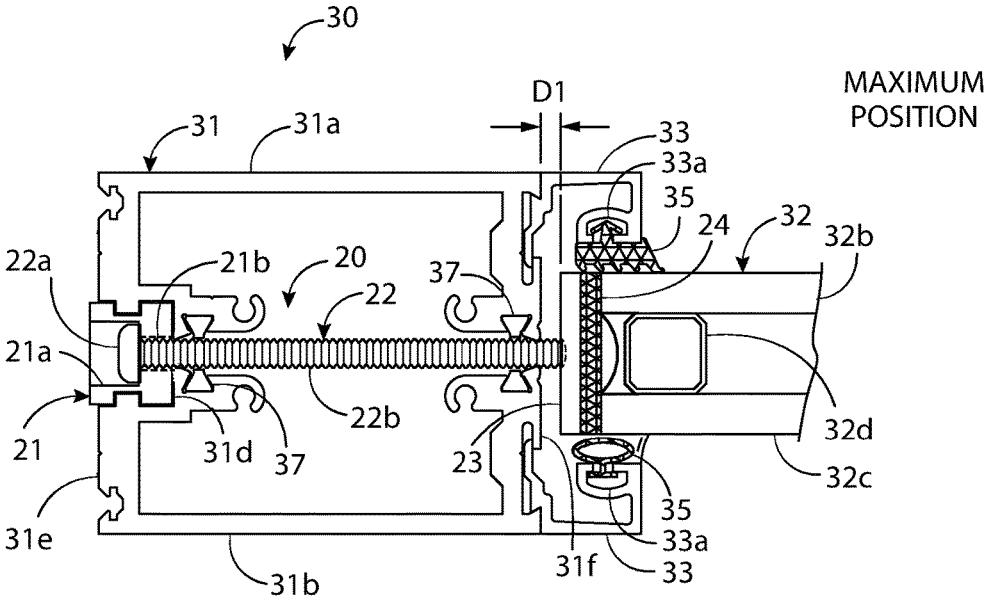
FIG. 8 illustrates a section view of the fenestration of FIG. 4 taken along section lines 8-8 with the setting block adjustment device adjusted to its maximum position.
Figure 9:
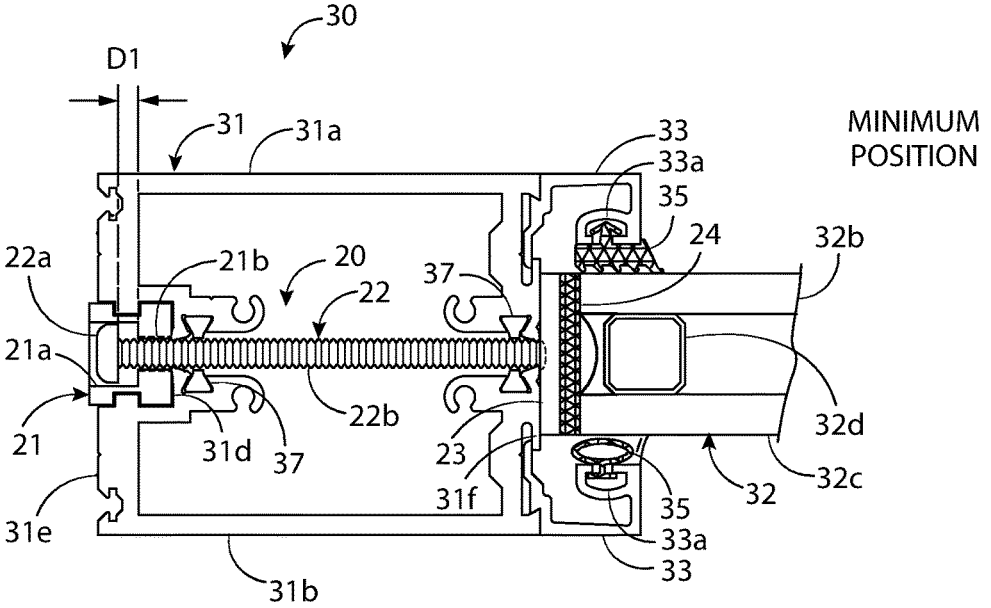
FIG. 9 illustrates the setting block adjustment device of FIG. 4 with the setting block adjustment device adjusted to its minimum position.
Figure 10:
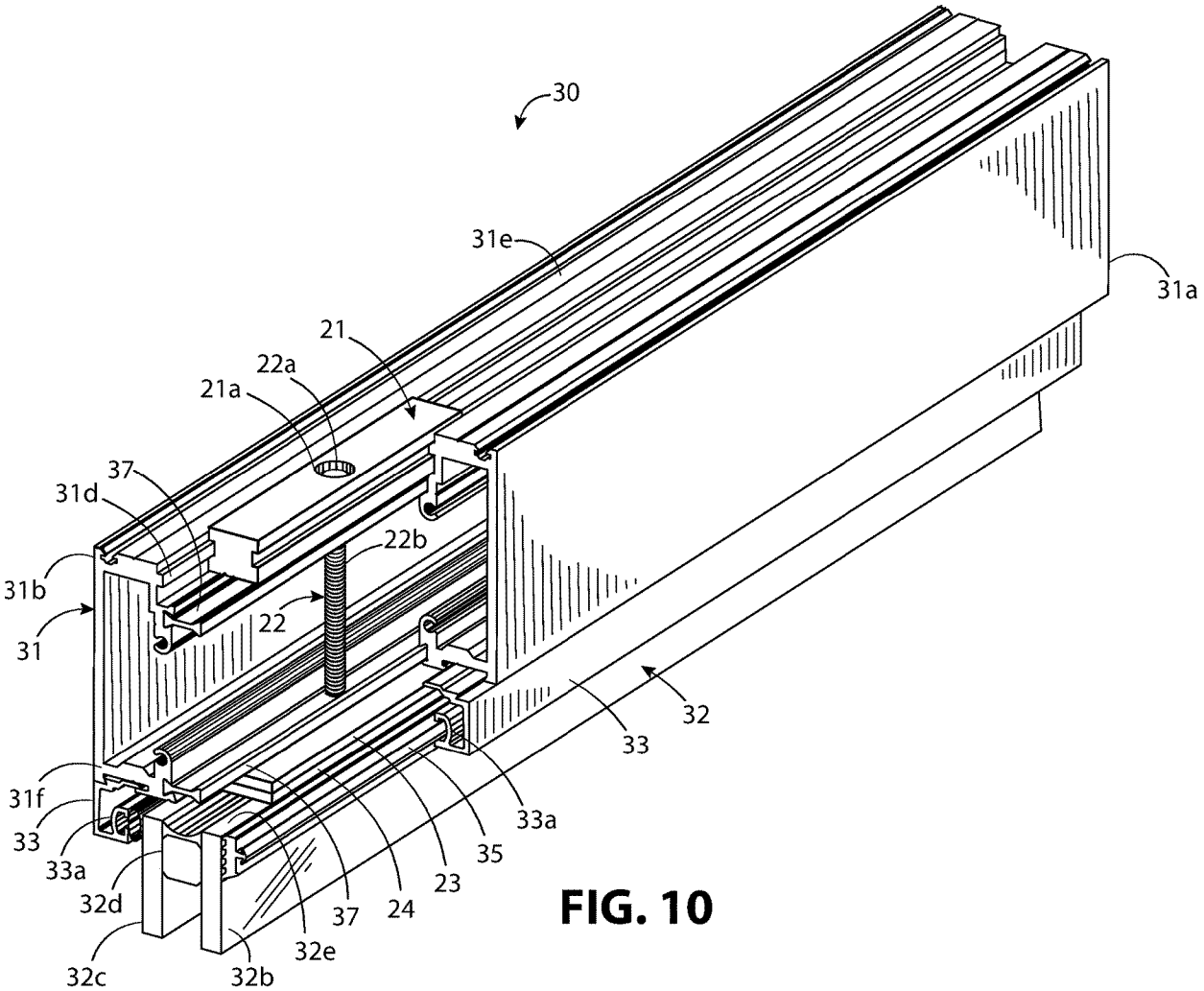
FIG. 10 illustrates a partial cutaway isometric view of a portion of FIG. 4.
Figure 11:
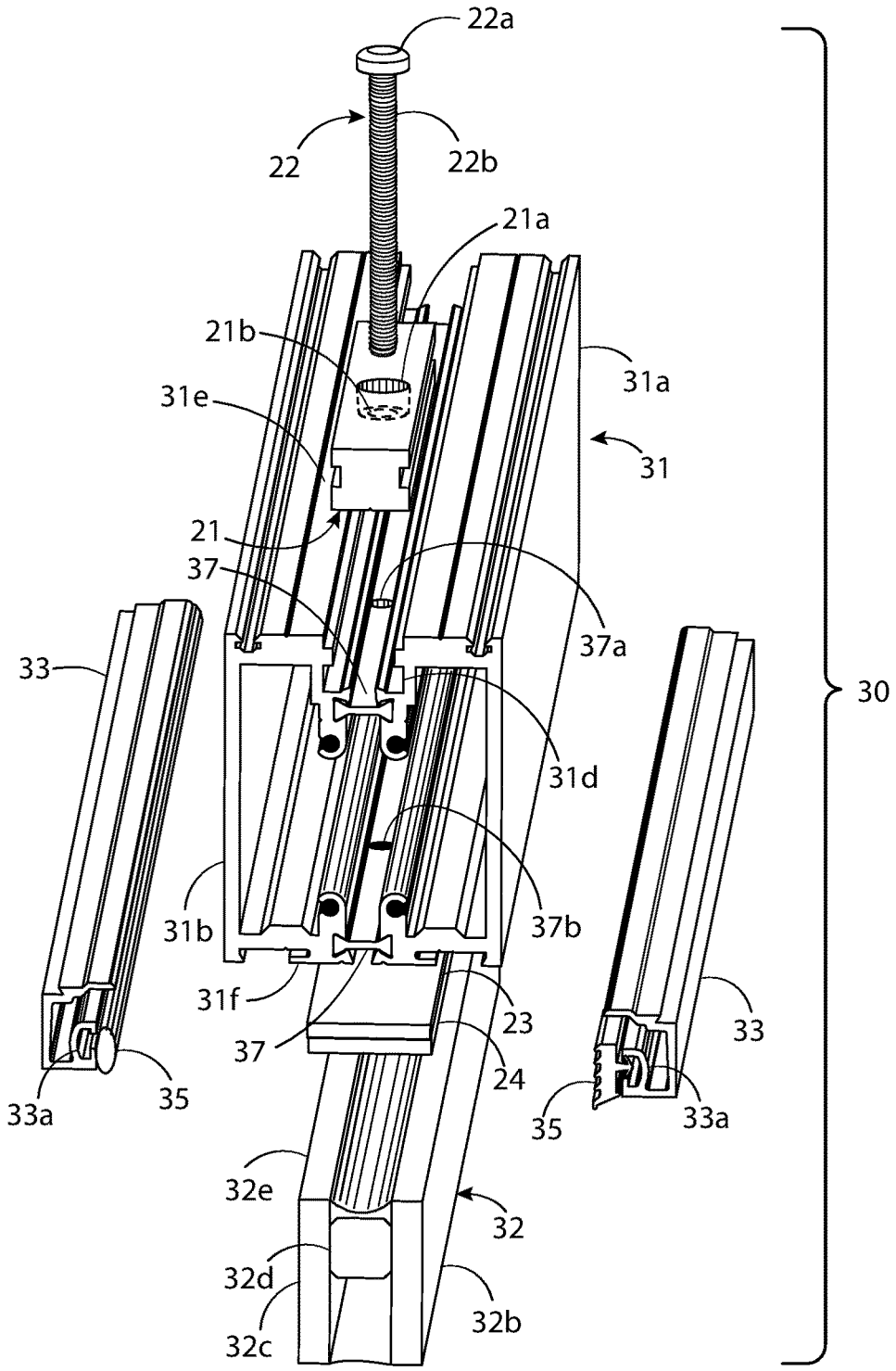
FIG. 11 illustrates a partially exploded view of a portion of FIG. 4.
Figure 12:
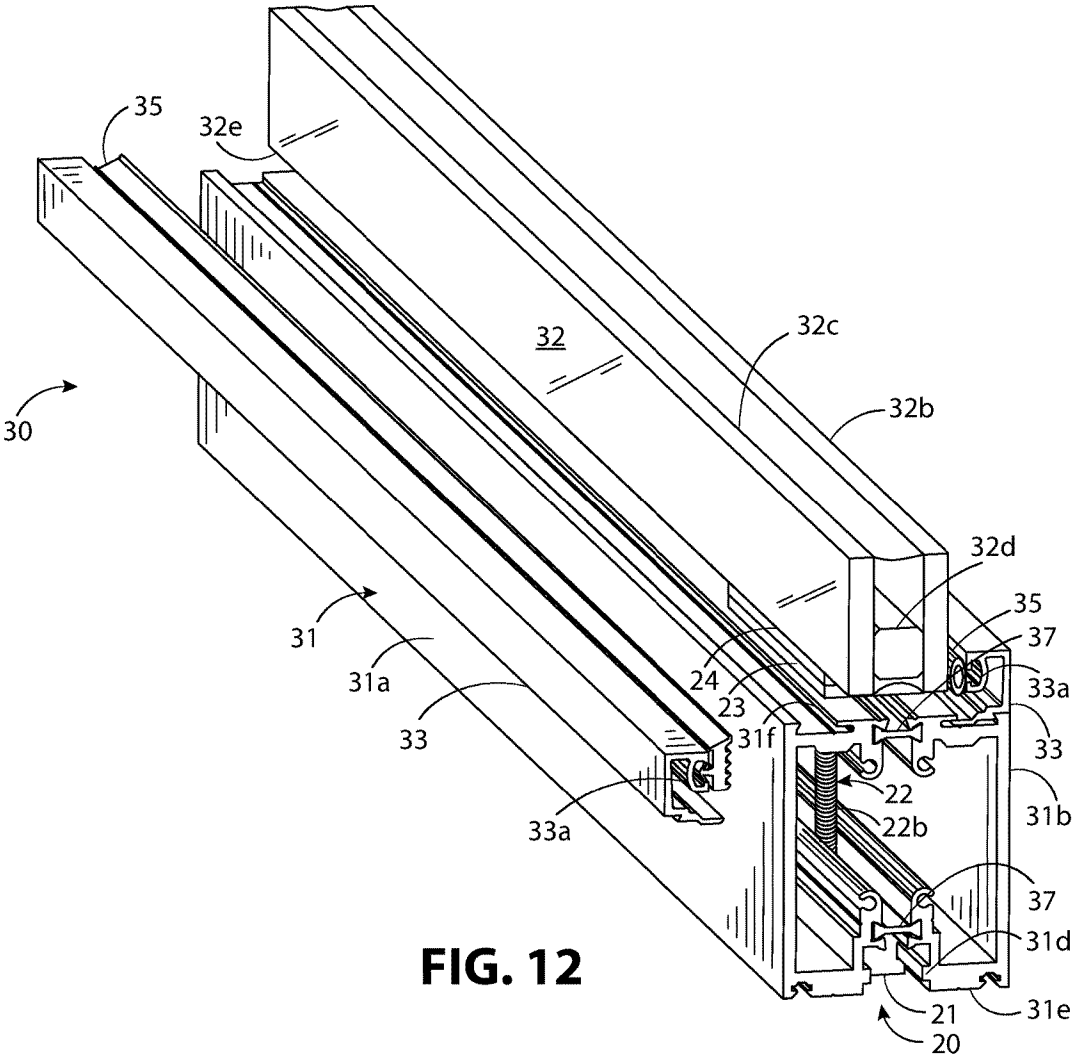
FIG. 12 illustrates a perspective view of a portion of FIG. 4 with a glazing stop removed to show placement and removal of the setting block and the setting block support plate.
Figure 13:
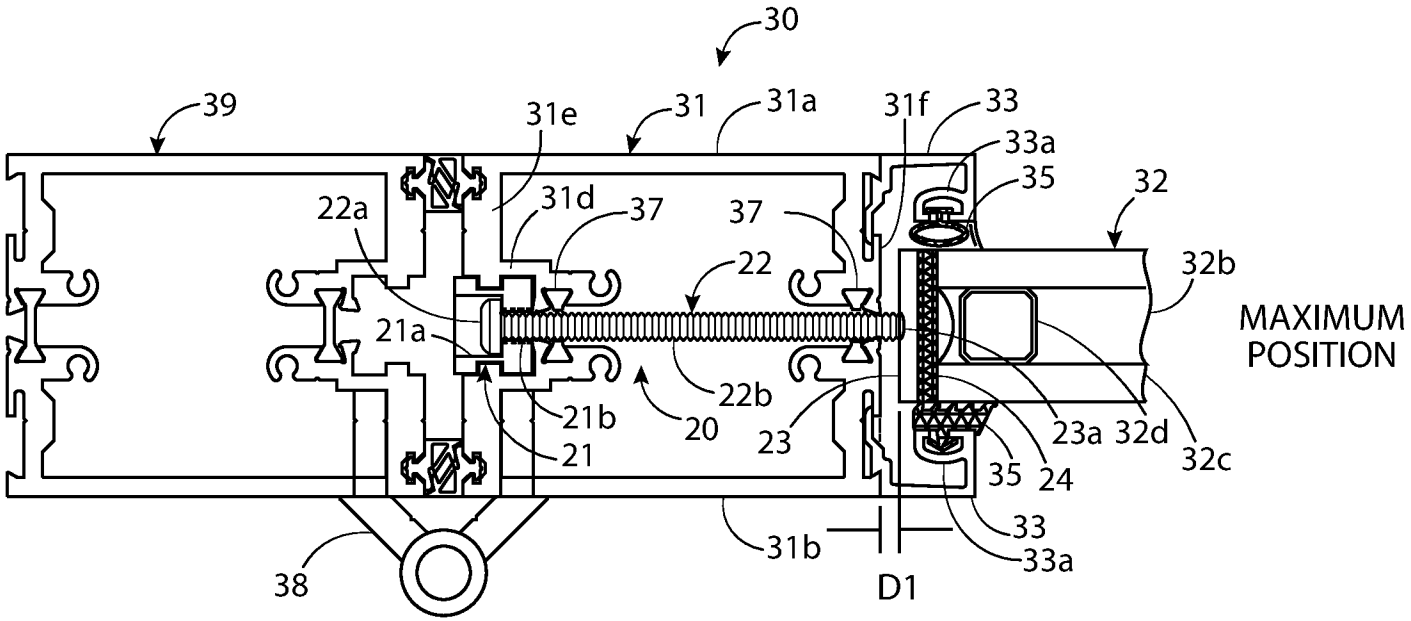
FIG. 13 illustrates the setting block adjustment device of FIG. 8 where a hinge attaches the fenestration frame and glazing assembly to a frame; the setting block adjustment device adjusted to its maximum position.
Figure 14:
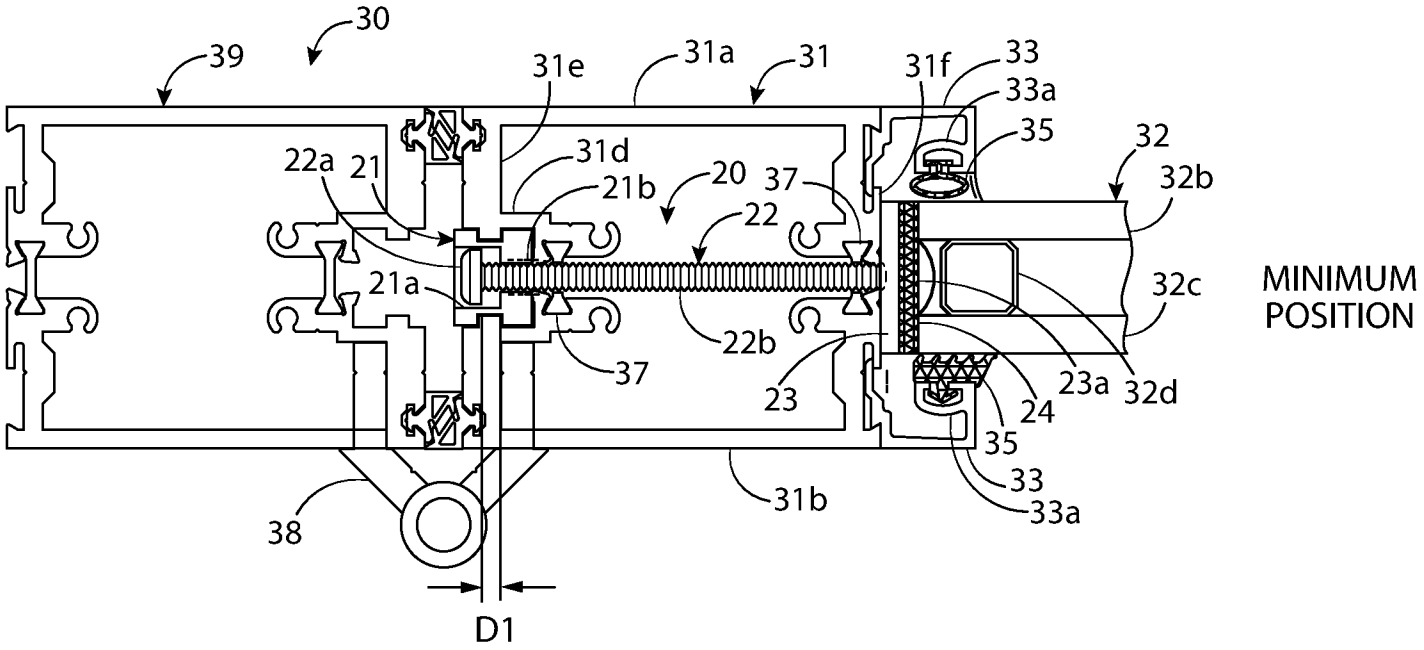
FIG. 14 illustrates the sectional view of FIG. 13 with the setting block adjustment device adjusted to its minimum position.
Figure 15:
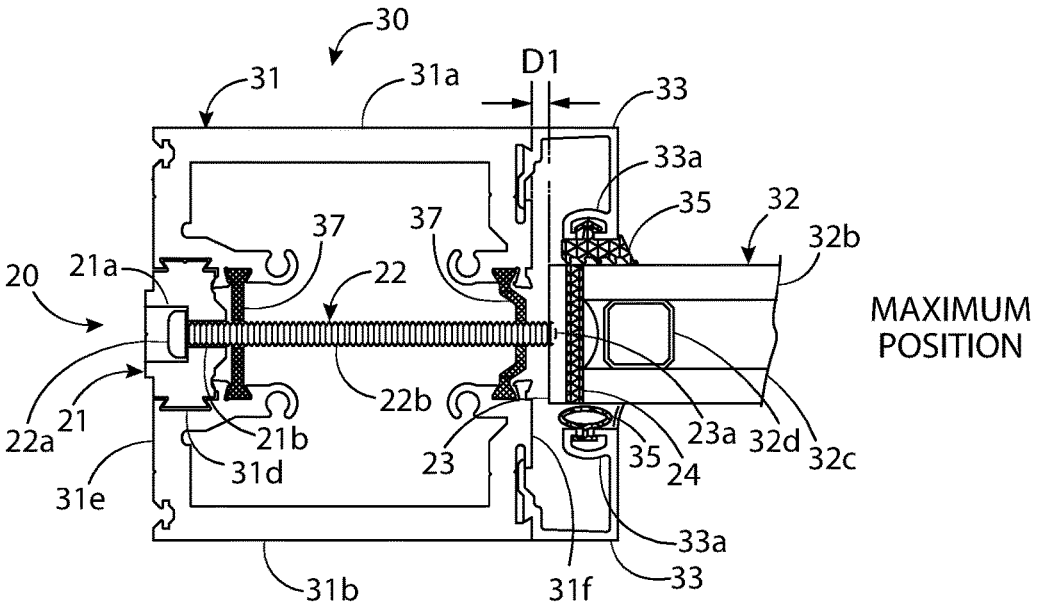
FIG. 15 illustrates a section view of an alternative fenestration frame utilizing a fourth alternative example of the setting block adjustment device where the setting block adjustment device is its maximum position.
Figure 16:
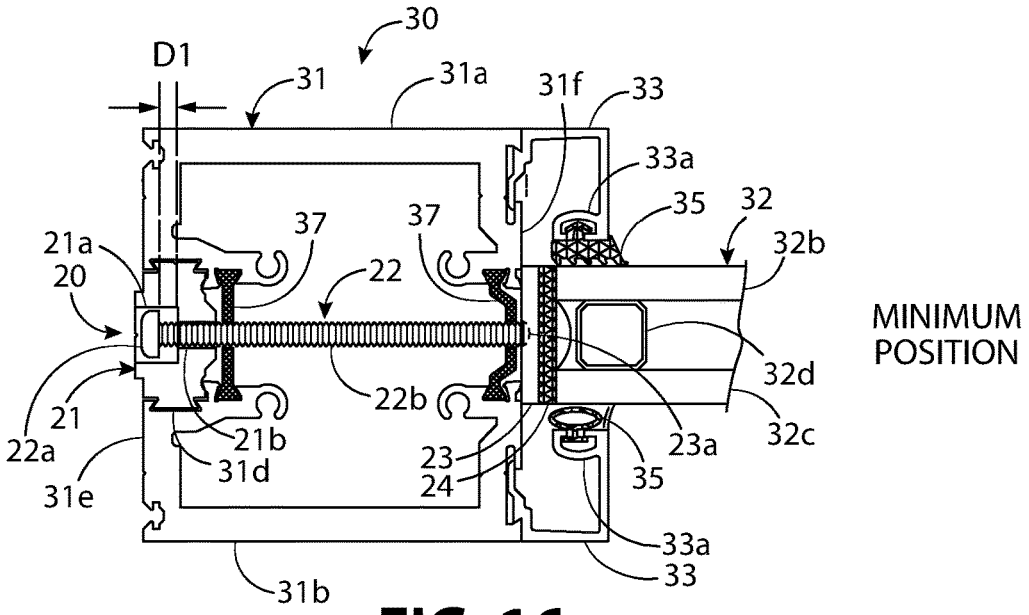
FIG. 16 illustrates the sectional view of FIG. 15 with the setting block adjustment device adjusted to its minimum position.
Figure 17:
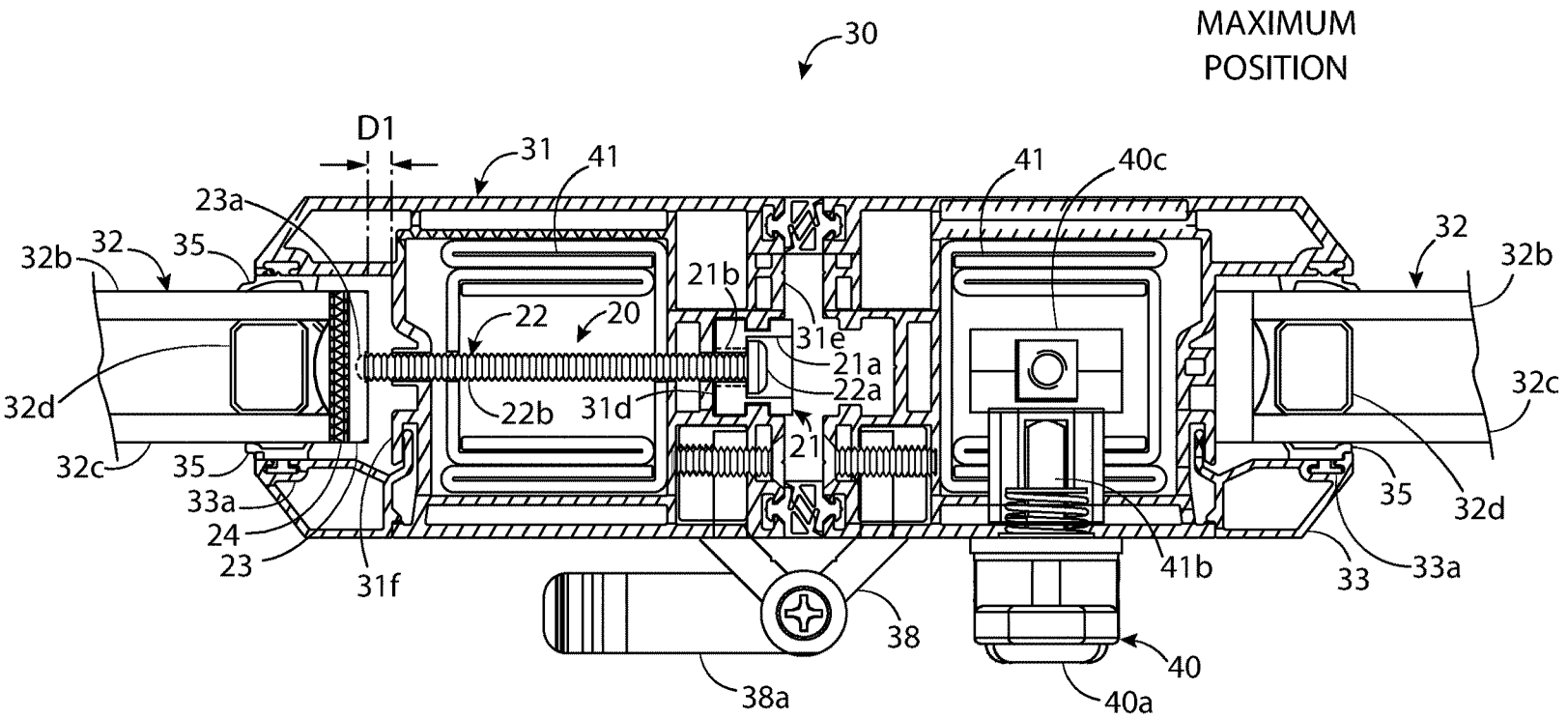
FIG. 17 illustrates the setting block adjustment device in a folded glass wall fenestration.
Figure 18:
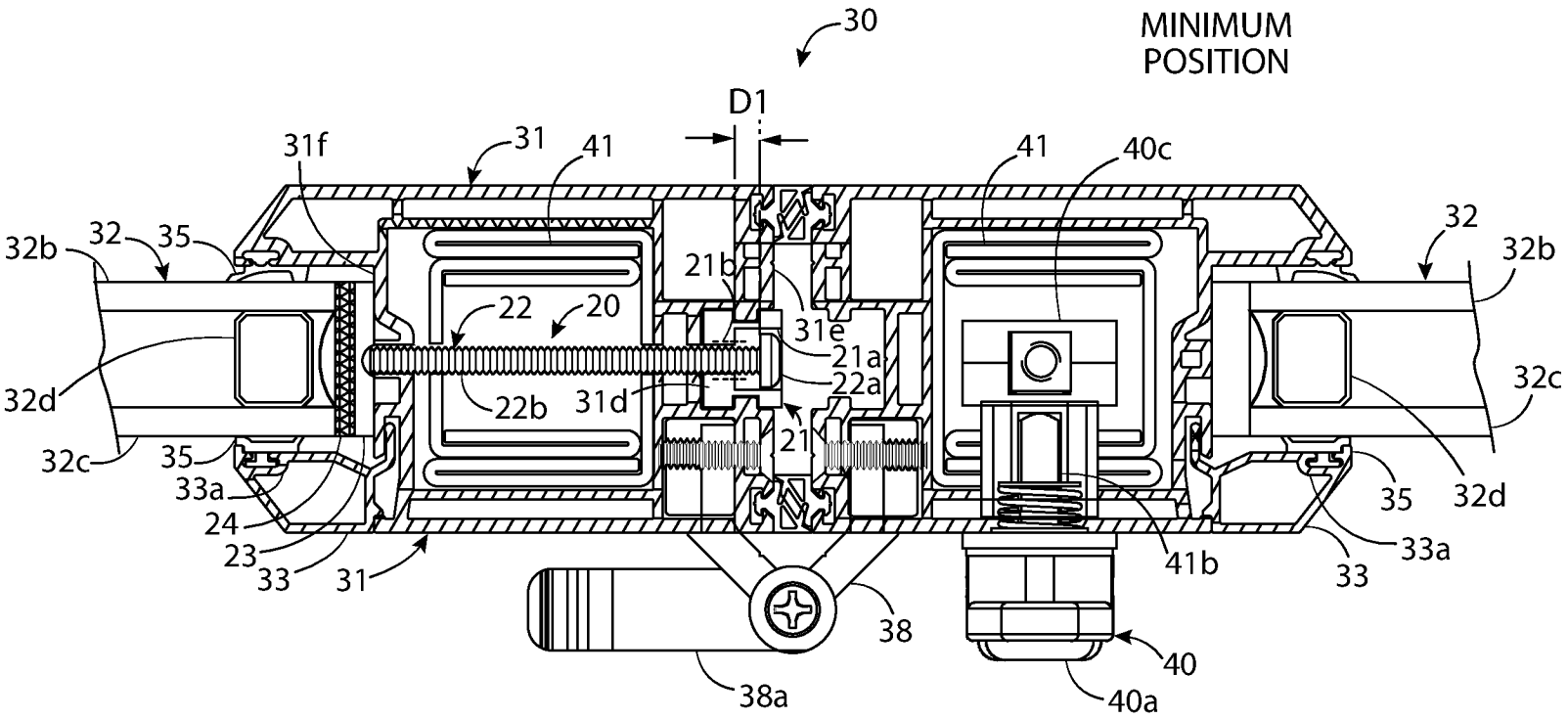
FIG. 18 illustrates the setting block adjustment device of FIG. 17 with the setting block adjustment device adjusted to its minimum position.
Figure 19:
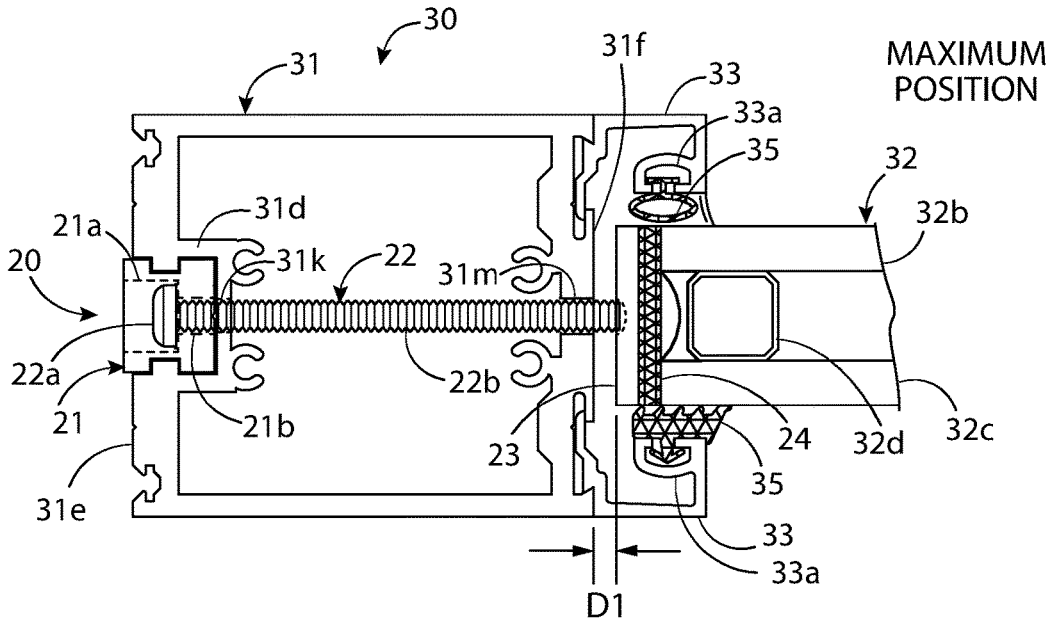
FIG. 19 illustrates, in section view, the setting block adjustment device utilized in fenestration frame assembly without a thermal break with the setting block device adjusted to its maximum position.
Figure 20:
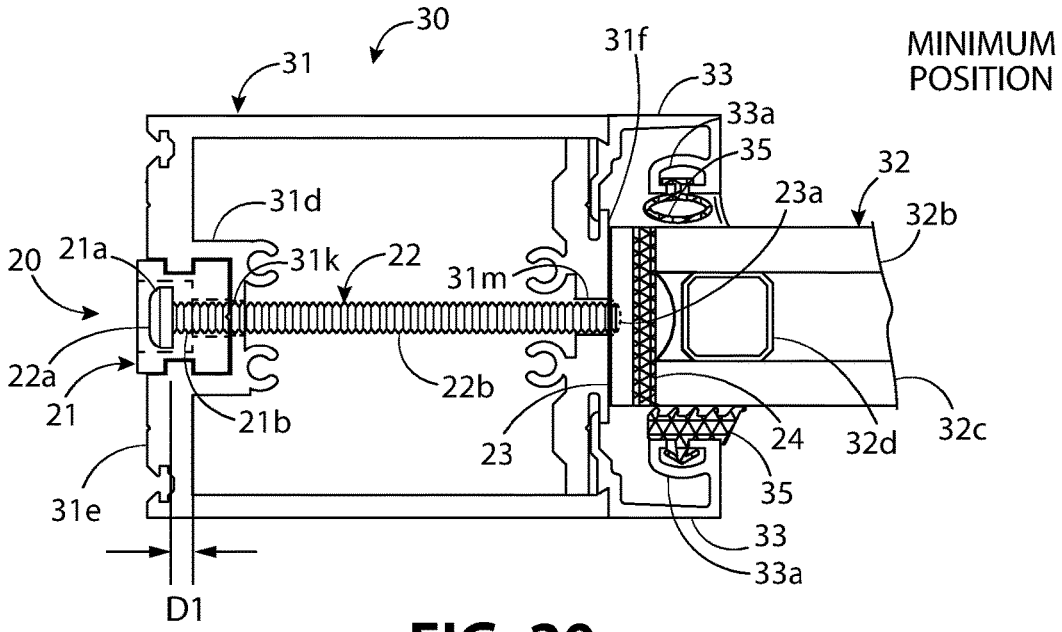
FIG. 20 illustrates the setting block device and the fenestration frame assembly of FIG. 19 with the setting block device adjusted to its minimum position.
Figure 21:
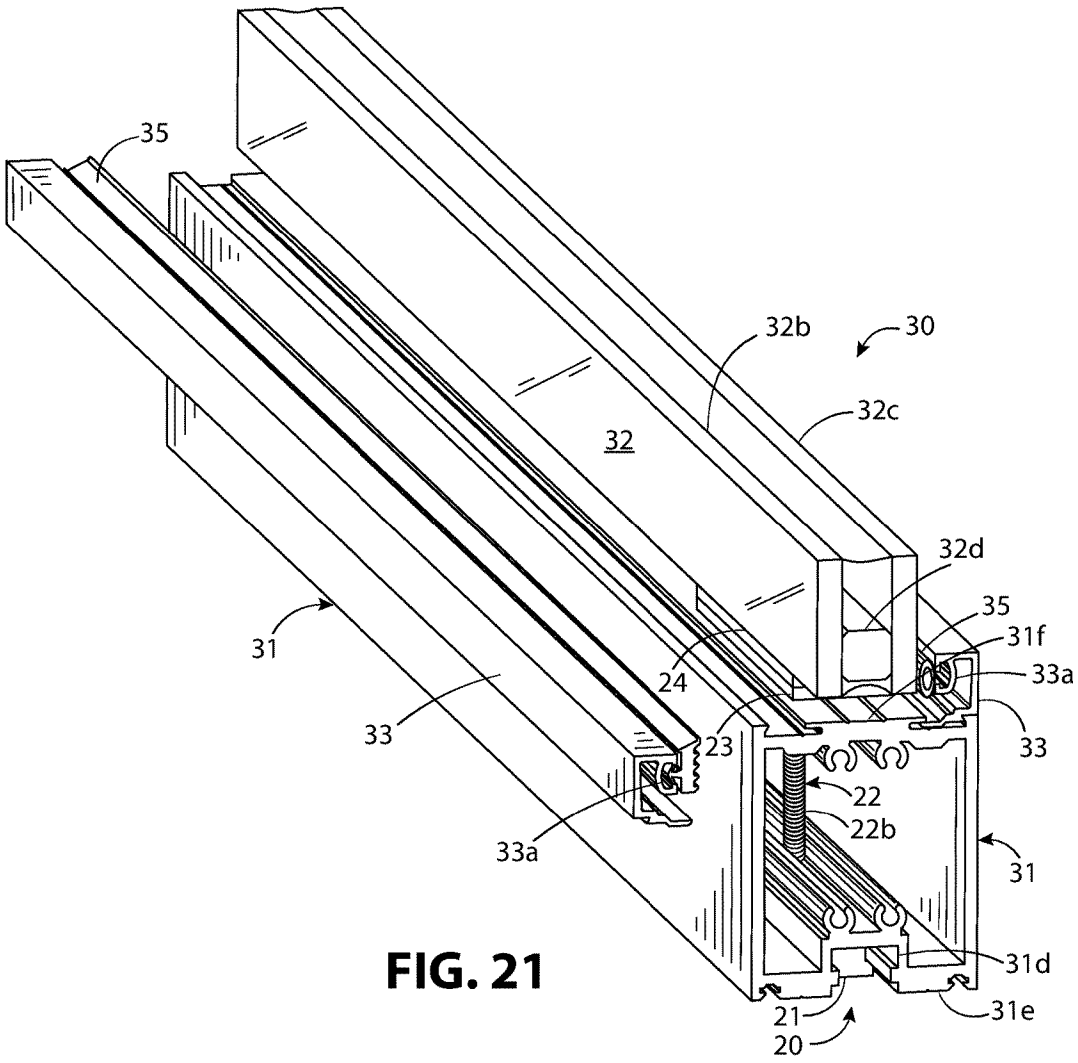
FIG. 21 illustrates a perspective view of the setting block device and fenestration frame assembly of FIG. 19.
Figure 39:
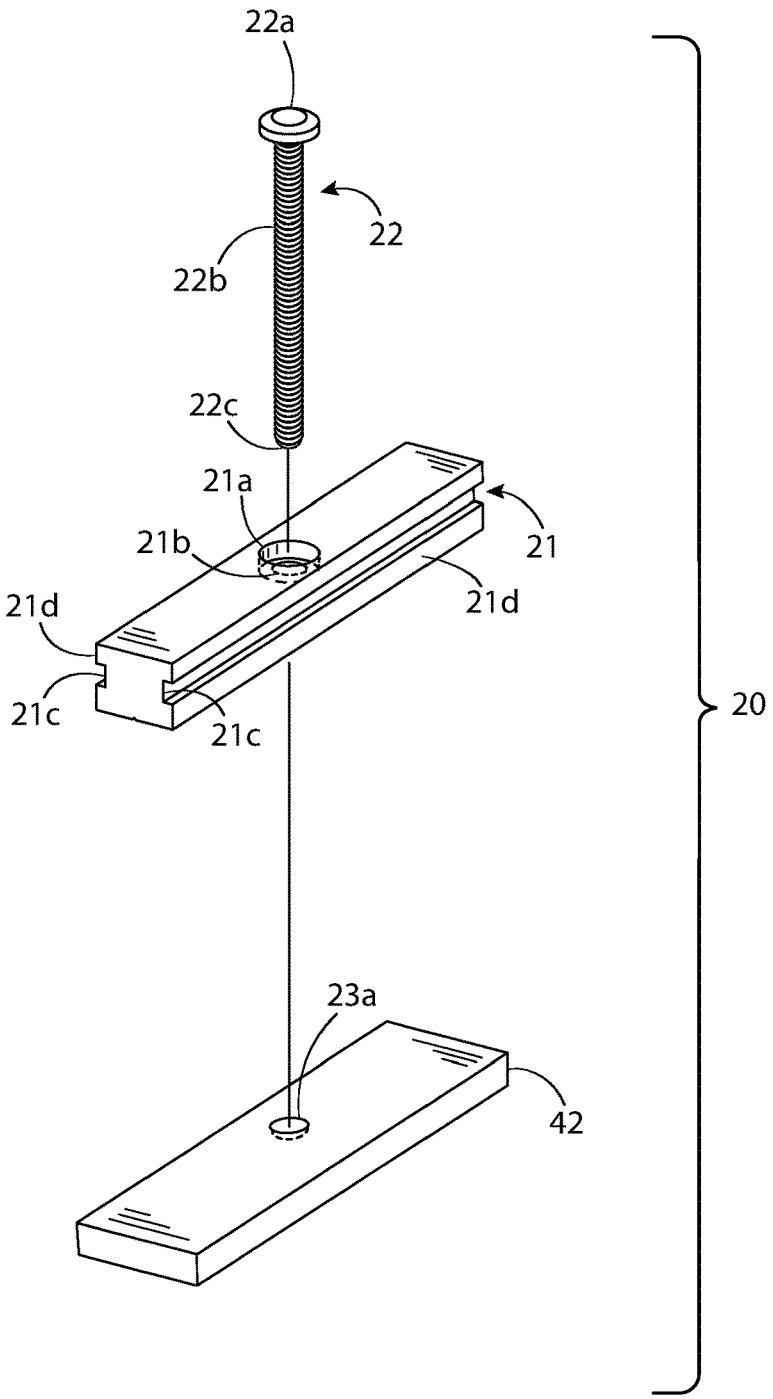
FIG. 39 illustrates, in exploded isometric view, the fifth alternative example of the setting block adjustment device of FIG. 37.
Figure 40:
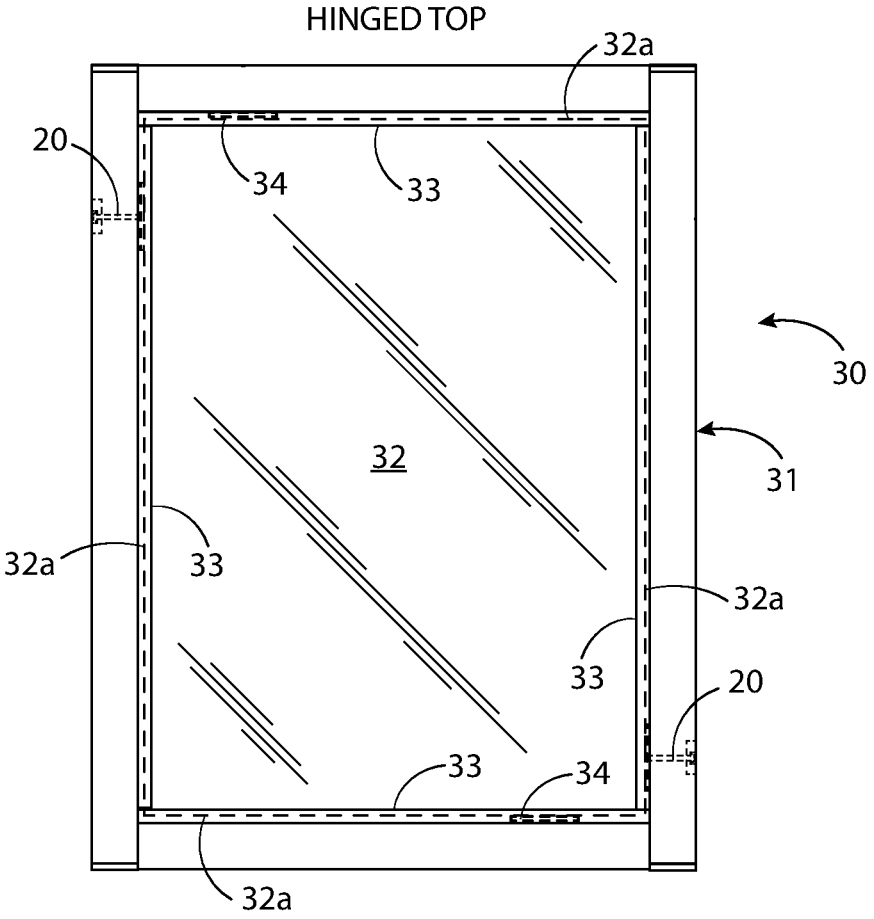
FIG. 40 illustrates a front view of a typical fenestration utilizing the setting block adjustment devices and hinged from the top.
Figure 41:
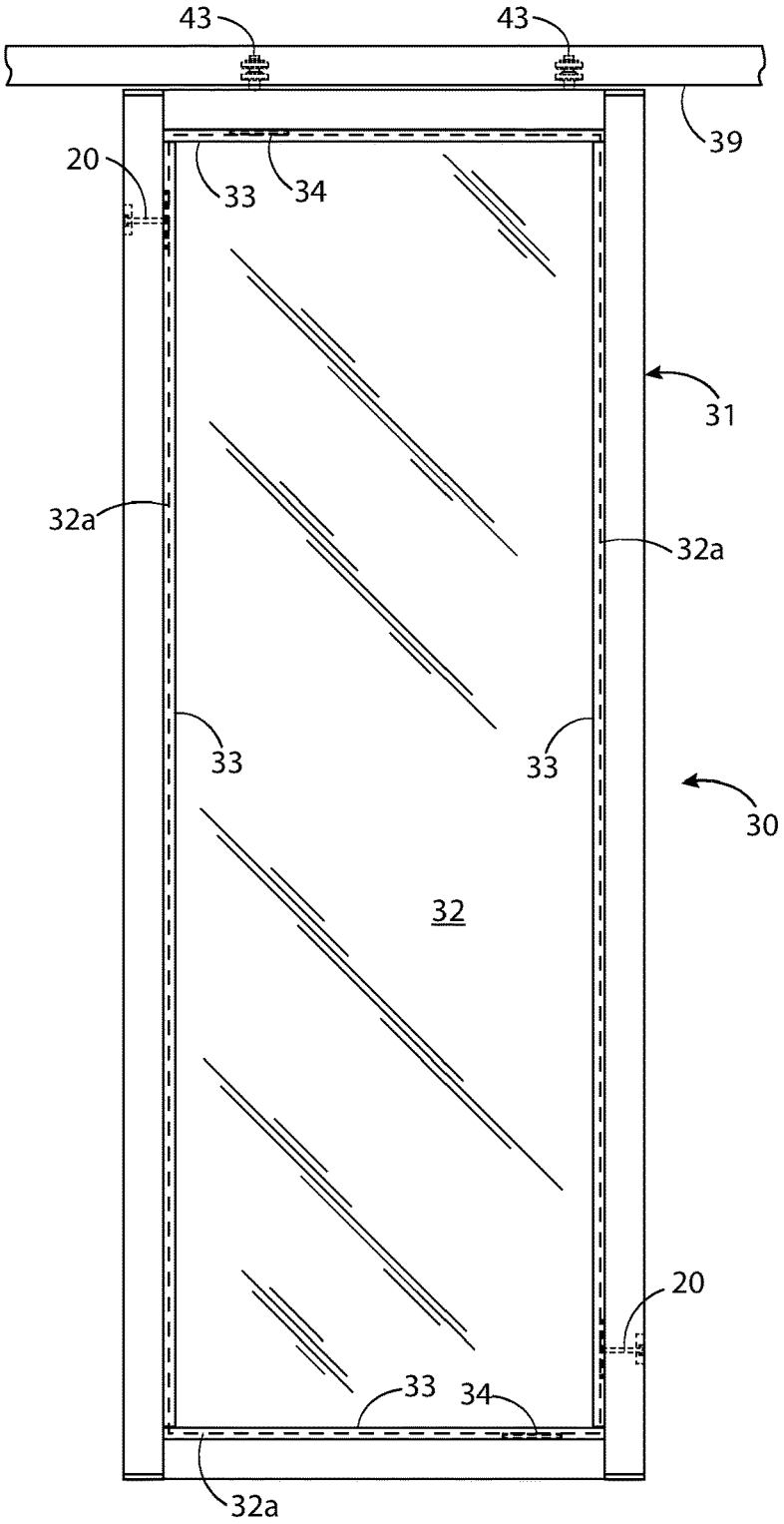
FIG. 41 illustrates a front view of a typical fenestration utilizing the setting block adjustment devices and slidably hung from the top.

FIG. 7 illustrates an upper right-hand portion of the fenestration of FIG. 4 taken along detail 7 with the portion enlarged magnification purposes. FIG. 8 illustrates a section view of the operable fenestration 30 of FIG. 4 taken along section lines 8-8 with the setting block adjustment device 20 adjusted to its maximum position with FIG. 9 illustrating the setting block adjustment device 20 adjusted to its minimum position. FIG. 10 illustrates a partial cutaway isometric view of a portion of FIG. 4. FIG. 11 illustrates a partial exploded view of a portion of FIG. 4. FIG. 12 illustrates a perspective view of a portion of FIG. 4 with a glazing stop 33 removed to show how the setting block adjustment device 20 can be placed and removed. FIGS. 13-21 illustrate the setting block adjustment device 20 applied in several fenestration environments. FIG. 13 illustrates the setting block adjustment device 20 of FIG. 8 where the operable fenestration frame 31 and infill panel 12 is attached by a hinge 38 to a frame 39, such as door or window frame), and the setting block adjustment device 20 is adjusted to its maximum position. FIG. 14 illustrates the section view of FIG. 13 with the setting block adjustment device 20 adjusted to its minimum position. FIGS. 15 and 16 illustrate, in section view, of an operable fenestration frame 31 utilizing a fourth alternative example of the setting block adjustment device 20. FIG. 15 illustrates the setting block adjustment device 20 set to its maximum position and FIG. 16 to its minimum position. FIGS. 17 and 18 illustrates the setting block adjustment device 20 in a folded glass wall fenestration. In FIG. 17, the setting block adjustment device 20 is adjusted to its maximum position and FIG. 18 to its minimum position. FIG. 19 illustrates, in section view, the setting block adjustment device 20 of FIG. 4 utilized in an operable fenestration frame 31 without a thermal break with the setting block adjustment device 20 adjusted to its maximum position. FIG. 20 illustrates the setting block device and the fenestration frame assembly of FIG. 19 with the setting block device adjusted 20 to its minimum position. FIG. 21 illustrates a perspective view of the setting block adjustment device 20 and operable fenestration frame 31 of FIG. 19. FIGS. 22-39, illustrate six examples of the setting block adjustment device 20 each in side view, front view, and top isometric view. FIGS. 40 and 41 illustrate how the setting block adjustment device can also be utilized in operable fenestrations either hung from the top (FIG. 40), or slidably hung from the top (FIG. 41).

Referring to FIGS. 7-39, the setting block adjustment device 20 includes a lug 21, a threaded fastener 22, a setting block support plate 23 (FIGS. 7-36), and a setting block 24 (FIGS. 7-36). The lug 21 can include a blind hole 21*a* inset in the top of the lug 21 and a threaded aperture 21*b* through the bottom of the blind hole 21*a* through the bottom of the lug 21. The blind hole 21*a* is optional but provides a mechanism for the screw head to not extend beyond the top of the lug 21 during operation. The threaded fastener includes a head 22*a* and a threaded body 22*b* extending from the head 22*a*. The threaded fastener can be a screw, bolt, or another threaded fastener capable performing the functions described within this disclosure and in combination with the lug 21 and operable fenestration frame 31, able to withstand the forces of normal operation of the operable fenestration 30. Referring to FIGS. 7-21, the lug 21 is slidably captive in a groove 31*d* along the lengthwise outside edge of the operable fenestration frame 31. The head 22*a* of the threaded fastener 22 rests against the bottom of the blind hole 21*a*. The threaded body 22*b* of the threaded fastener 22 threadedly engages the threaded aperture 21*b* and extends through the bottom of the blind hole 21*a*.

Referring to FIGS. 7, 8, 13, 15, 17, and 19, the infill panel 32 is positioned a maximum distance away from the inner face 31*f* of the operable fenestration frame 31. The inner face 31*f* is along the inside perimeter surface of the operable fenestration 30. The threaded body 22*b* threadedly engages the blind hole 21*a* with the head 22*a* of the threaded fastener 22 resting against the bottom of the blind hole 21*a*. With the threaded fastener 22 adjusted to this position, the end of the threaded body 22*b* presses against the setting block support plate 23 and the setting block 24. The setting block support plate 23 is pushed a distance D1 away from the inner face 31*f* of the operable fenestration frame 31. The infill panel 32, which rests against the setting block, is also moved a distance D1 from its original position.

Referring to FIGS. 9, 14, 16, 18, and 20, the infill panel 32 is positioned a minimum distance away from the inner face 31*f* of the operable fenestration frame 31. The threaded body 22*b* threadedly engages the blind hole 21*a* with the head 22*a* of the threaded fastener 22 positioned a distance D1 away from the bottom of the blind hole 21*a*. With the threaded fastener 22 adjusted to this position, the end of the threaded body 22*b* retracts a distance D1 toward the inner face 31*f* of the operable fenestration frame 31 from its position in FIGS. 7, 8, 13, 15, 17, and 19. Because the infill panel 32 is under tension from the operable fenestration frame 31, the infill panel 32, the setting block 24 and setting block support plate 23 moves a distance D1 so the setting block support plate 23 rests against the inner face 31*f* of the operable fenestration frame 31.

Referring to FIGS. 8-21, the outward facing surfaces of the infill panel 32 are held in place against the operable fenestration frame 31 by glazing stops 33. Referring to FIGS. 10 and 11, a perimeter edge portion 32*e* of the infill panel 32 (i.e. a portion of the perimeter edge 32*a* of the infill panel 32 of FIGS. 4-7) rests against the setting block 24 and is held in place by the setting block 24 in combination the rest of the setting block adjustment device 20. Referring to FIGS. 8-21, the glazing stops 33 are illustrated as being securable to and removable from the operable fenestration by a tongue and slot arrangement. Other arrangements, known in the art that allow a glazing stop 33 to be secured and removed from the operable fenestration 30 can be used. The glazing stops 33 can include glazing gaskets 35 that cushions the infill panel 32 from the glazing stop 33. The glazing gasket 35 are shown snapping into a slot 33*a* in the glazing stop 33. The infill panel 32 is illustrated as an IGU with a pair of glass panels 32*b*, 32*c* held apart by a spacer 32*d*, sealed at the ends, and separated by air, gas, or a vacuum. While the infill panel 32 is illustrated as a double pane IGU, the inventor envisions the setting block adjustment device working with a variety of infill panels. For example, the infill panel 32 can other IGU structures such as a triple pane IGU. The IGU glazing material is not limited to glass but can be other glazing material, for example, acrylic and polycarbonate. The infill panel 32 can be a glazing insert, for example, with a foam core sandwiched between two sheets of aluminum. The infill panel 32 can be also be a single-pane of material such as, for example, glass, acrylic, polycarbonate, wood, or metal.

Referring to FIGS. 8-21, the setting block adjustment device 20 combined with an operable fenestration frame 31 and the groove 31*d* that extends lengthwise along the operable fenestration frame 31 has these advantages and unexpected results.

First, the setting block adjustment system derives its strength a combination of the lug 21 and distributed forces across the groove 31*d* within the operable fenestration frame 31. This makes the setting block adjustment device 20 suitable for a wide range of frame types including aluminum, wood, vinyl, and fiberglass.

Second, because the lug 21 is slidably captive, the strength of the setting block adjustment system does not depend on the tension strength of the threaded fastener 22. The combination of lug 21, threaded fastener 22, and groove 31*d* can be significantly stronger than the shear strength of the threaded fastener 22 itself.

Third, the setting block adjustment device 20 can adjust the infill panel 32 or operable fenestration frame 31 while the operable fenestration 30 is in place and in operation. The heads 22*a* of the threaded fasteners 22 can be easily accessed to adjust the threaded fasteners 22 from within the grooves 31*d* while the operable fenestration 30 is hung on its hinges.

Fourth, the setting block adjustment device 20 combined with operable fenestration frame 31 is that setting block adjustment device 20 can be positioned almost anywhere along the operable fenestration frame 31 without compromising its structural integrity. For example, referring to FIG. 7 with cross-blocking, it may be desirable to place the setting block adjustment devices 20 equal distance from the perimeter edge 32*a* of the infill panel 32 so distance D3 equals distance D4. distance D3 and distance D4 could for example, be set to 6 inches (0.152 meters) or any other distance for cross-blocking. Distance D3 and distance D4 can also be unequal for cross-blocking, or can be equal or unequal for other applications.

Fifth, referring to FIGS. 8-21, the setting block adjustment devices 20 can be added, removed, or repositioned while the operable fenestration 30 is operational. There is no need to remove the operable fenestration 30 from its hinges. For example, the setting block adjustment device 20 can be moved to a different location along the operable fenestration frame 31 as follows. A hole can be drilled in each of the thermal struts 37 (FIGS. 8-16), or through the bottom of the groove 31*d* and the inner face 31*f* (FIGS. 17-21) at the desired location. For example, FIG. 11 shows aperture 37*a* in the thermal strut 37 located proximate to the outer face 31*e* (the first thermal strut) and aperture 37*b* located proximate to the inner face 31*f* (the second thermal strut). The threaded fastener 22 can be loosened to leave the lug 21 free to captively-slide within groove 31*d*. Removing the glazing stop 33, as shown in FIG. 12, accesses the setting block support plate 23 and the setting block. The lug 21, setting block support plate 23 and setting block 24 can be moved to the new position over the newly drilled hole (i.e., apertures 37*a*, 37*b* in FIG. 11 or apertures 31*k*, 31*m* in FIGS. 19 and 20). The threaded fastener 22 can be tightened, so it passes through the newly drilled holes (i.e., apertures 37*a*, 37*b* in FIG. 11 or apertures 31*k*, 31*m* in FIGS. 19 and 20) and engages the setting block support plate 23. Note that the threaded fastener 22 non-threadedly engages apertures 37*a*, 37*b* (FIG. 11) or apertures 31*k*, 31*m* (FIGS. 19 and 20) so these are typically unthreaded or at least not threaded to engage the threaded fastener 22. Adding a setting block adjustment device 20 can follow a similar procedure adding, instead of moving, a lug 21, threaded fastener 22, setting block support plate 23, and a setting block 24.

Sixth, the inventor envisions using the setting block adjustment device 20 in a wide variety of fenestrations. These include, for example, swing doors, folding doors, swing windows, folding windows, folding glass walls, hung doors, and other operable fenestrations.

Seventh, while the lug 21 need not be aligned over the infill panel 32, it can be aligned over the infill panel 32. For example, in FIGS. 8-16 the groove 31*d* is directly aligned over the infill panel 32 and directly over the thermal struts 37.

FIGS. 13 and 14 shows a hinged door opening using the setting block adjustment device 20 and operable fenestration frame 31. Referring to FIGS. 13 and 14, a hinge 38 joins the operable fenestration frame 31 to the frame 39. The frame 39 can surround a building opening or can surround a fixed glazing (i.e. fixed lite). The setting block adjustment device 20 can easily be adjusted while the operable fenestration 30 is in service. For example, if the operable fenestration 30 is a door or side-hinged window, the door or window can be swung open exposing the head 22*a* of the threaded fastener 22 for adjustment. While FIGS. 13 and 14 show the operable fenestration frame 31 hinged to a frame 39, another operable fenestration frame can directly replace the frame 39.

Folding doors and windows, or folding glass walls, can also use the setting block adjustment device 20. For example, in FIGS. 17 and 18, the setting block adjustment device 20 is used combined with an operable fenestration 30 in a folding glass wall. The folding glass wall include a hinge 38 and optionally, a hinge-pull 38*a*. The structure can include a lock, such as the multi-point lock 40 with lock cylinder 40*a*, spindle 40*b*, and a multi-point latch 40*c*. The structure illustrated can be fabricated with vinyl, fiberglass, or other materials, and can optionally include a stiffener 41 made of steel, aluminum, or other reinforcing material.

In FIGS. 8-16, the operable fenestration frame 31 includes two thermally isolated sub-members: a first fenestration frame sub-member 31*a* and a second fenestration frame sub-member 31*b*. The first fenestration frame sub-member 31*a* and a second fenestration frame sub-member 31*b* are separated and thermally isolated by thermal struts 37 (a first thermal strut located proximate to the outer face 31*e* and a second thermal strut located proximately to the inner face 31*f*). The thermal strut 37 are made of a thermally insulating material, for example, polyamide. The thermal struts 37 can be made of other thermally insulating material with sufficient strength to allow the operable fenestration frame 31 to withstand the forces applied in everyday operation. Thermal struts typically run the entire length of each fenestration frame sub-member and are typically held in place by crimping. Thermal isolated or "thermally broken" operable fenestrations frames are typically found in operable fenestration frames made of a thermally conductive material, such as aluminum. The setting block adjustment device 20 can work equally well in a non-thermally isolated operable fenestrations frames such as the operable fenestration frame 31 illustrated in FIGS. 17-21. Referring to FIGS. 17-21, the operable fenestration frames 31 are not thermally broken and form single bodies. For example, the operable fenestration frame 31 can be formed from a single extrusion. Typically, non-thermally broken frames can be made of wood, vinyl, or fiberglass. However, conductive materials, such as aluminum can be used where thermal isolation is not important. For example, in mild climates or passages within interior spaces.

Figure 22:
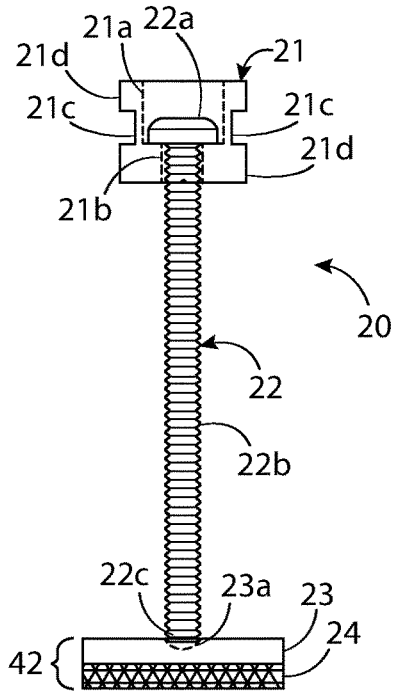
FIG. 22 illustrates, in side view, the setting block adjustment device of FIG. 4 removed from the fenestration assembly.
Figure 23:
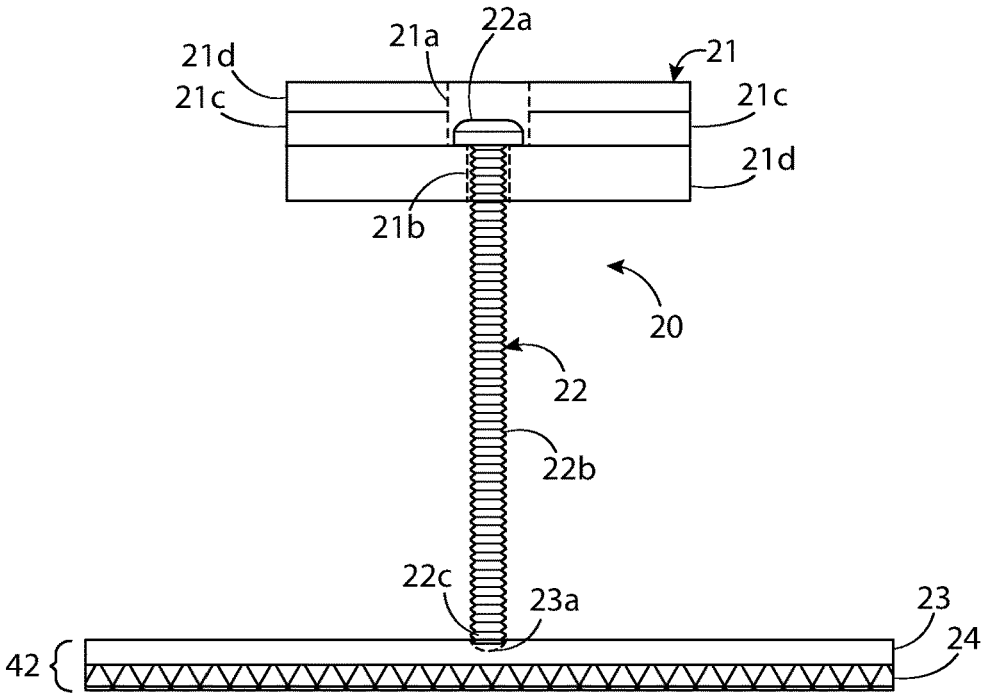
FIG. 23 illustrates, in front view, the setting block adjustment device of FIG. 22.
Figure 24:
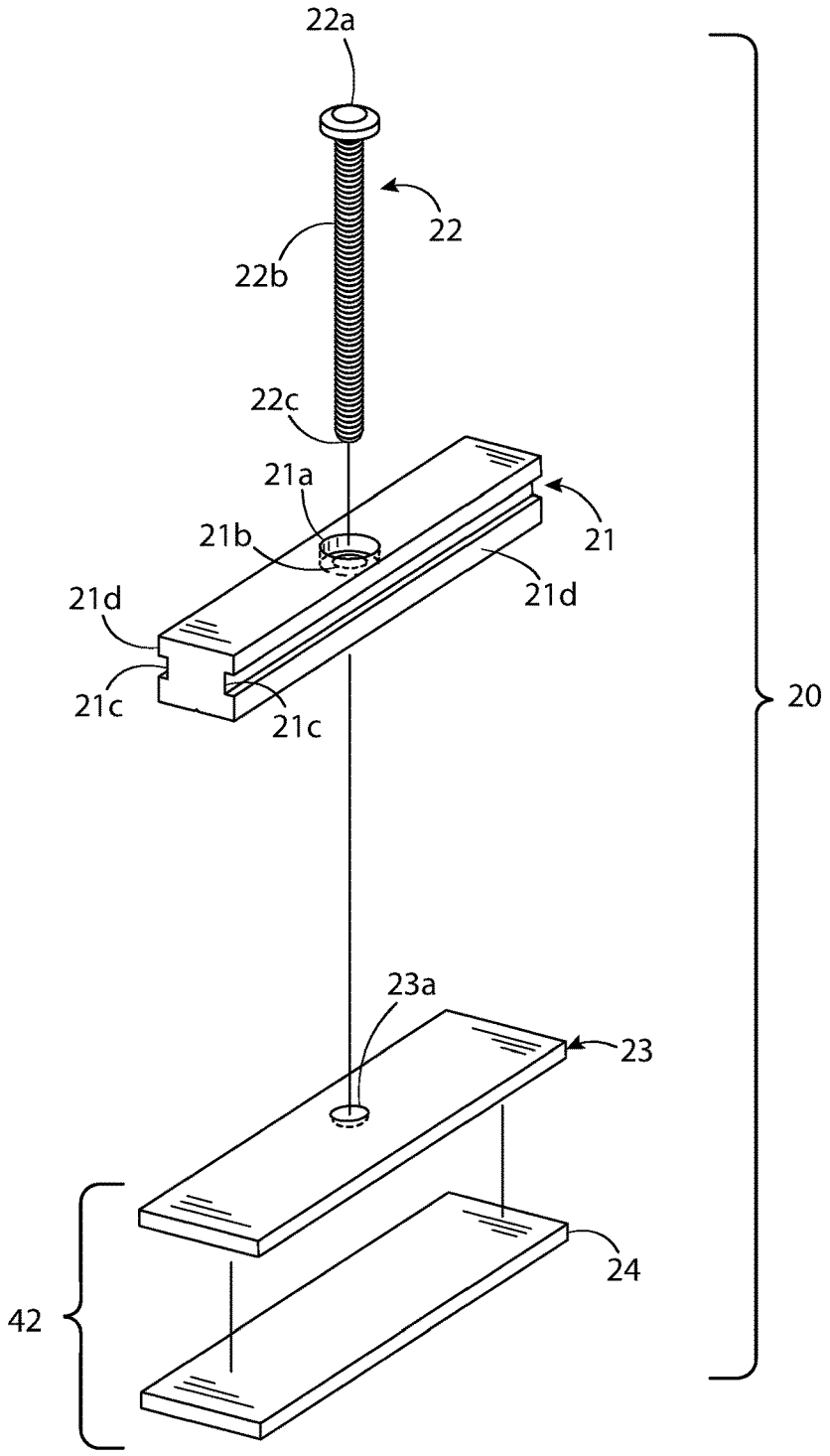
FIG. 24 illustrates, in exploded isometric view, the setting block adjustment device of FIG. 22.
Figure 25:
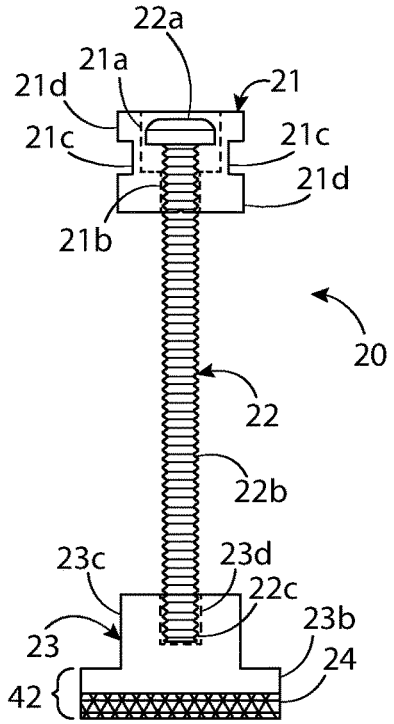
FIG. 25 illustrates, illustrates, in side view, an alternative example of the setting block adjustment device.
Figure 26:
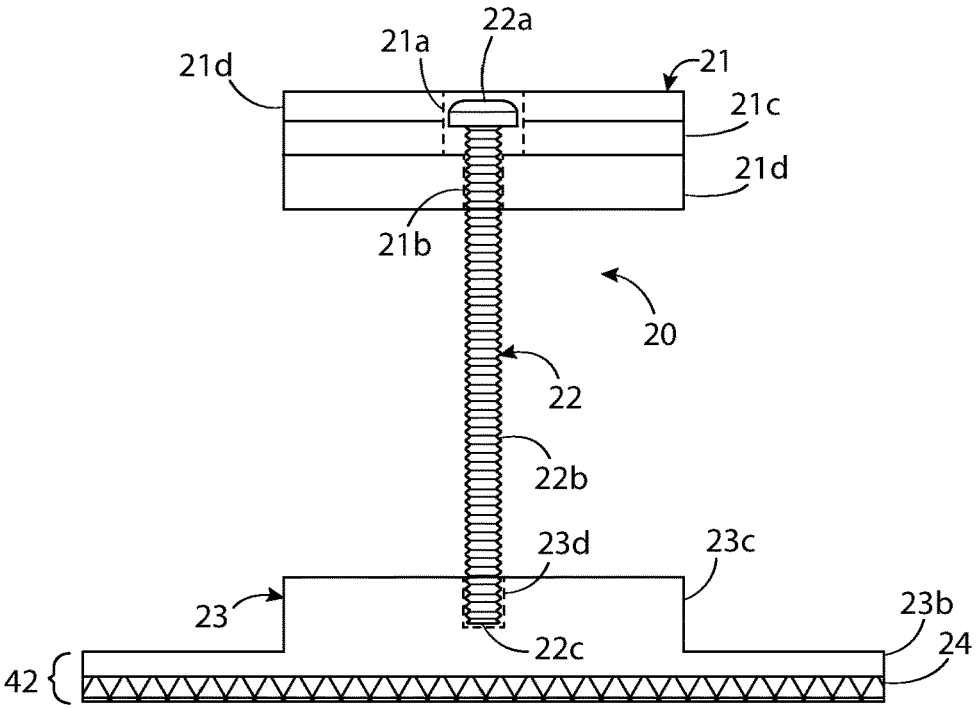
FIG. 26 illustrates, in front view, the alternative example of the setting block adjustment device of FIG. 25.
Figure 27:
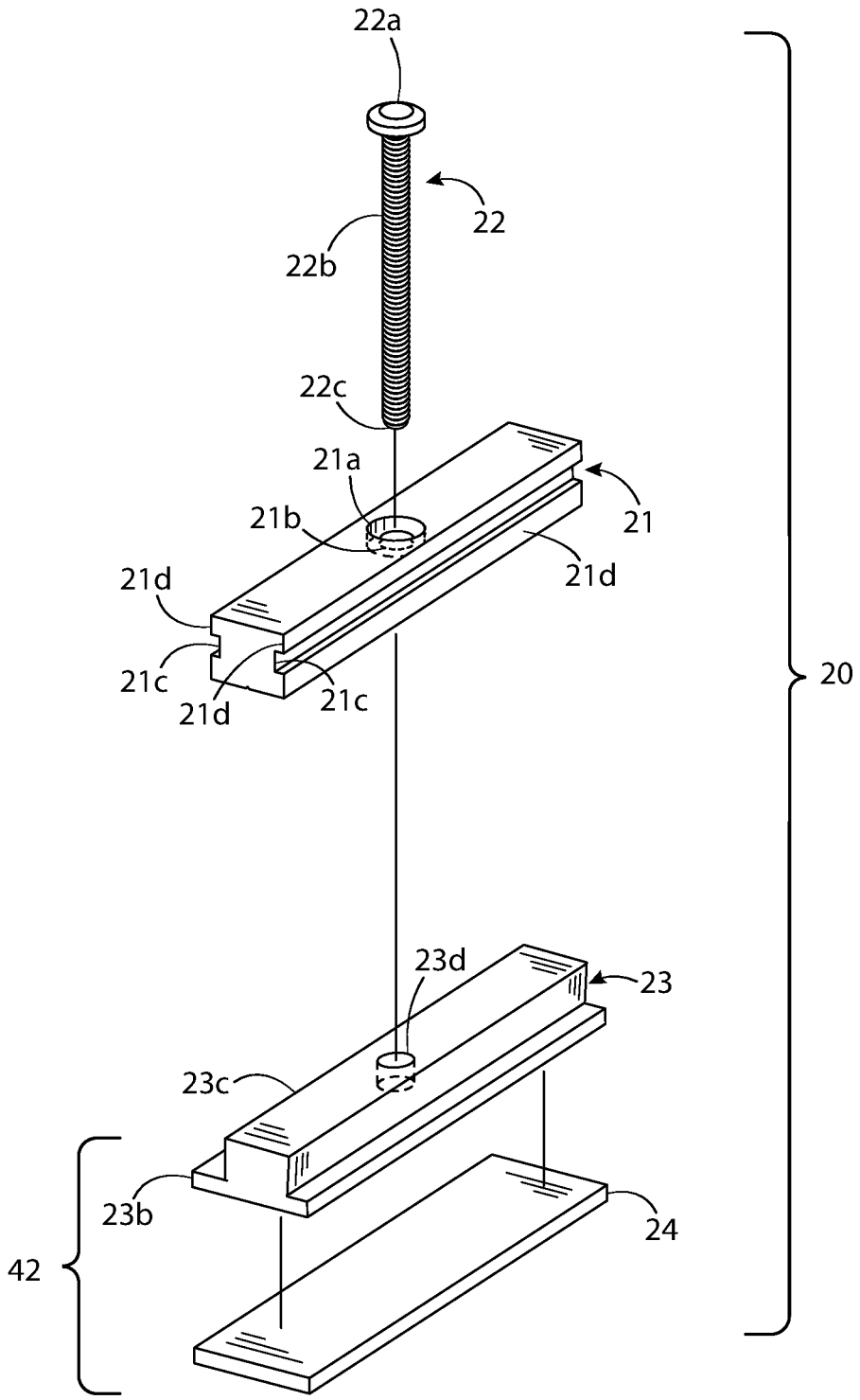
FIG. 27 illustrates, in exploded isometric view, the alternative example of the setting block adjustment device of FIG. 25.

FIGS. 8-14, 17, and 18 show the setting block adjustment device 20 illustrated in FIGS. 22-24. Referring to FIGS. 22-24, the fastener end 22*c* engages a detent 23*a* in the top surface of the setting block support plate 23. The detent 23*a* helps the fastener end 22*c* engage the setting block support plate 23 without slipping. The detent 23*a* is optional. The fastener end 22*c* can engage the top surface of the setting block support plate 23 directly when slippage is not a concern. The inventor envisions a wide range of variations of the setting block support plate 23 within the scope of the setting block adjustment device 20. For example, in FIGS. 25-27, a projected portion 23*c* projects upward from the setting block support plate 23. The fastener end 22*c* non-threadedly engages a blind hole 23*d* in the projected portion 23*c* and pushes against the bottom of the blind hole 23*d*. Note that when referring to the blind hole 21*a* of the lug 21 and blind hole 23*d* of the setting block support plate 23, for convenience we can refer to the blind hole 21*a* as a first blind hole and the blind hole 23*d* as a second blind hole.

Figure 28:
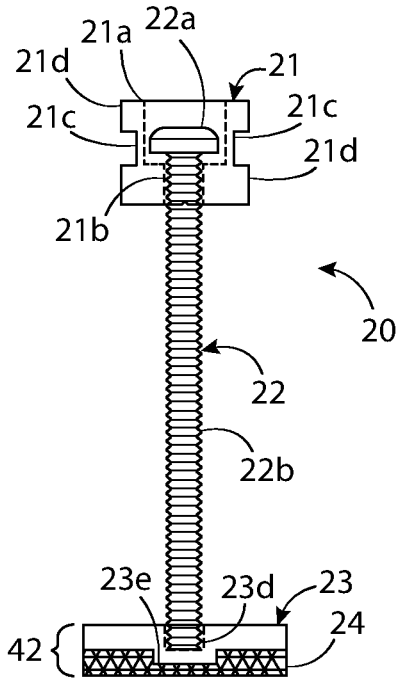
FIG. 28 illustrates in side view, a second alternative example of the setting block adjustment device.
Figure 29:
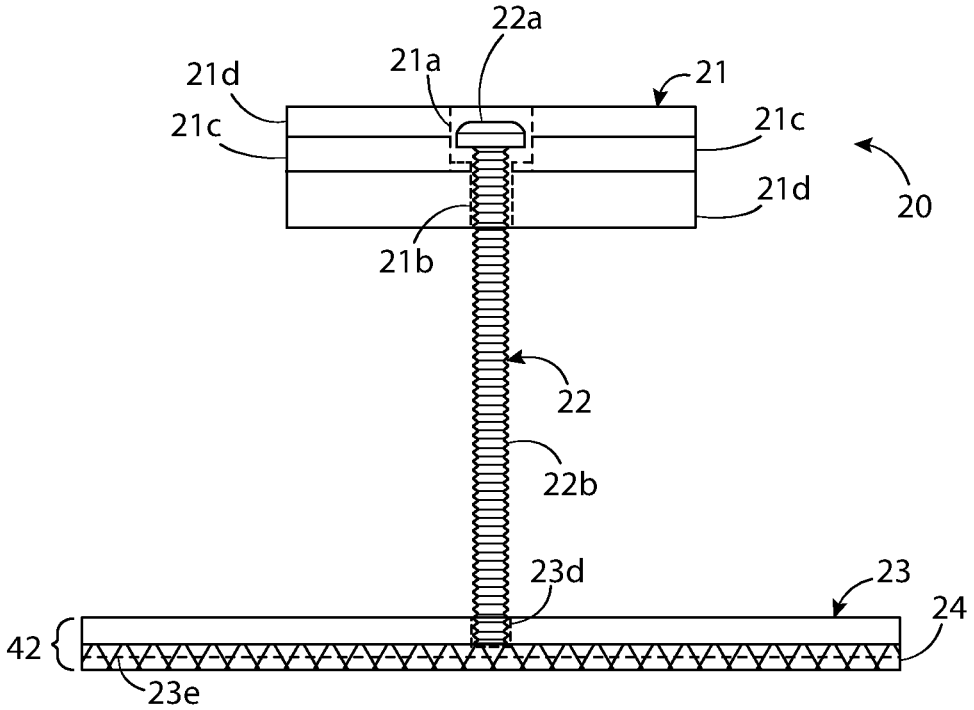
FIG. 29 illustrates in front view, the second alternative example of the setting block adjustment device of FIG. 28.
Figure 30:
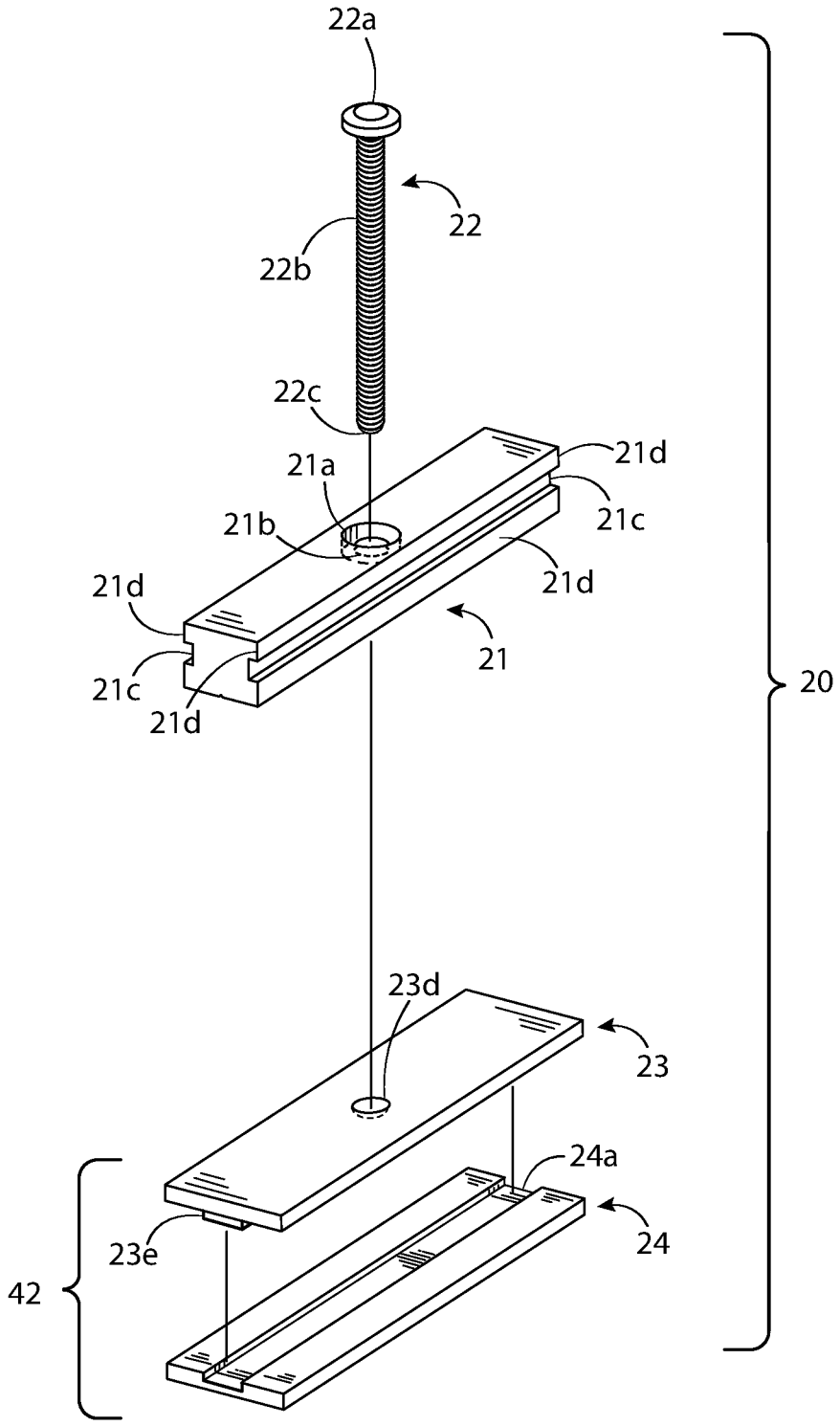
FIG. 30 illustrates an exploded isometric view, of the second alternative example of the setting block adjustment device of FIG. 28.

In FIGS. 28-30, a toothed projection 23*e* projecting downward from the setting block support plate 23 (FIGS. 28-30) projects into a slot 24*a* (FIG. 30) in the setting block 24. In FIG. 30, the toothed projection 23*e* and the slot 24*a* extends lengthwise along the entire length of the setting block support plate 23 and the setting block 24 respectively. This structure prevents the setting block 24 from rotating regarding the setting block support plate 23. This configuration allows for both the setting block support plate 23 and the setting block 24 to be manufactured by extruding although they can be molded, stamped, or otherwise formed. The toothed projection 23*e* and the slot 24*a*, in this example, can be other shapes that prevent rotation of setting block support plate 23 regarding the setting block 24 such as a square, rectangle, or other polygon and need not extend the entire length of the setting block support plate 23 and the setting block 24.

Figure 31:
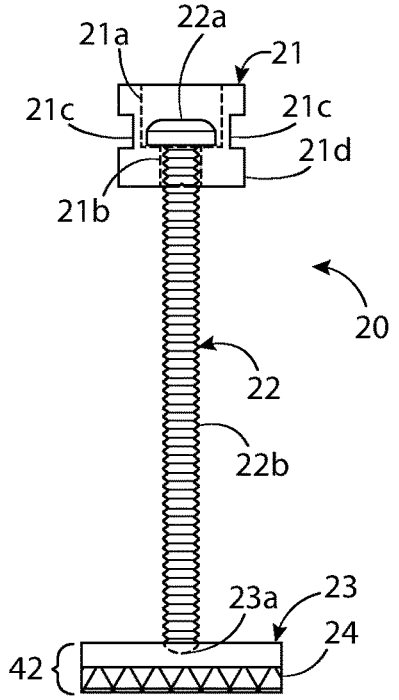
FIG. 31 illustrates in side view, a third alternative example of the setting block adjustment device using multiple threaded fasteners.
Figure 32:
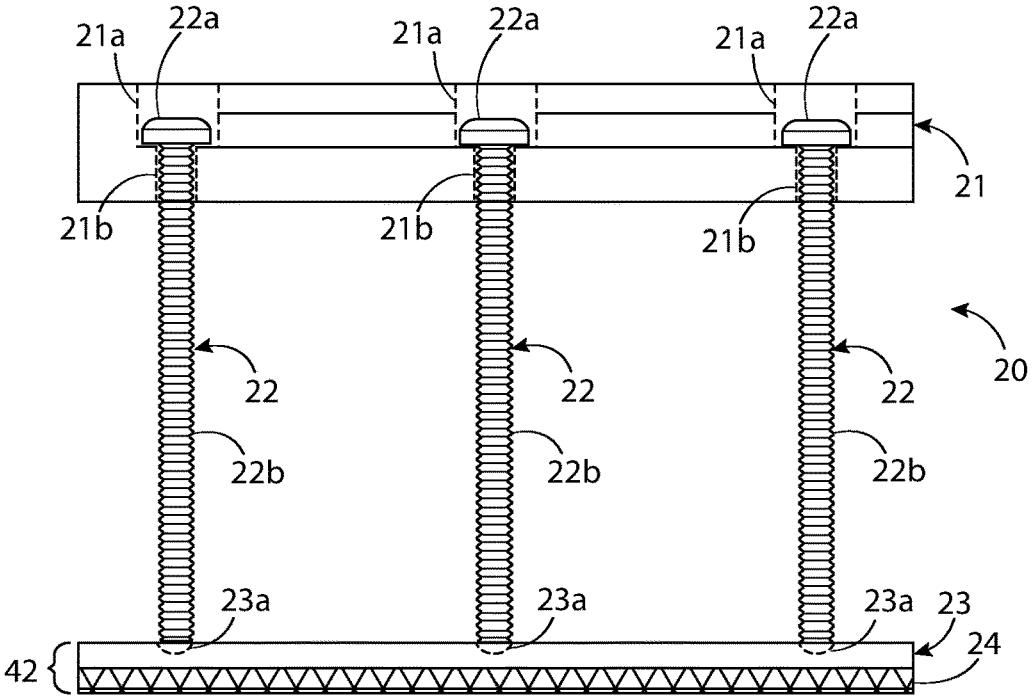
FIG. 32 illustrates in front view, the third alternative example of the setting block adjustment device of FIG. 31.
Figure 33:
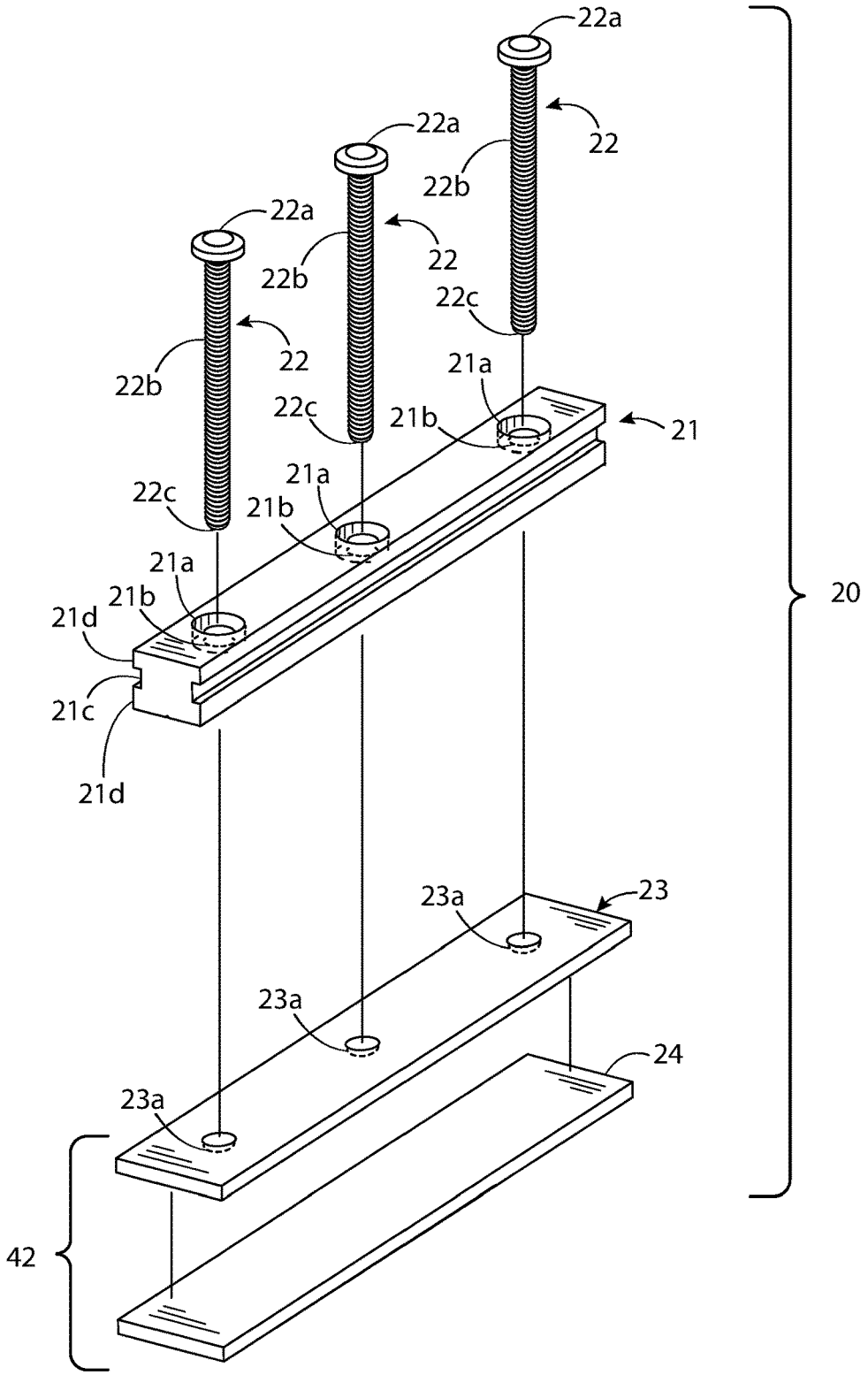
FIG. 33 illustrates an exploded isometric view, the third alternative example of the setting block adjustment device of FIG. 31.

The inventor recognized that it may be desirable to exert more control over the angle of the infill panel 32 and more evening distribute the pressure over the perimeter edge 32*a* of the infill panel 32. This may be especially helpful for large heavy doors. FIGS. 31-33 illustrates a setting block adjustment device 20 utilizing two or more threaded fasteners 22 engaging different portions of the setting block support plate 23. In FIGS. 31-33 three of the threaded fasteners 22 engage three of the detents 23*a* positioned in the top surface of the setting block support plate 23. Two or more threaded fasteners 22 with a corresponding two or more detents 23*a* can be used according to the application.

Figure 34:
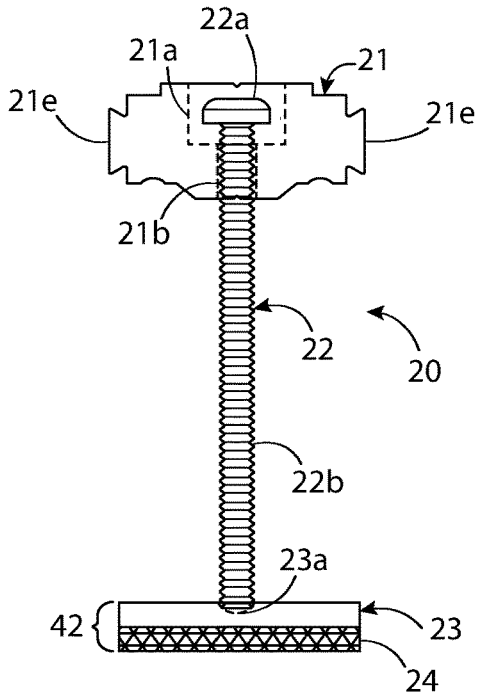
FIG. 34 illustrates in side view, the fourth alternative example of the setting block adjustment device using multiple threaded fasteners.
Figure 35:
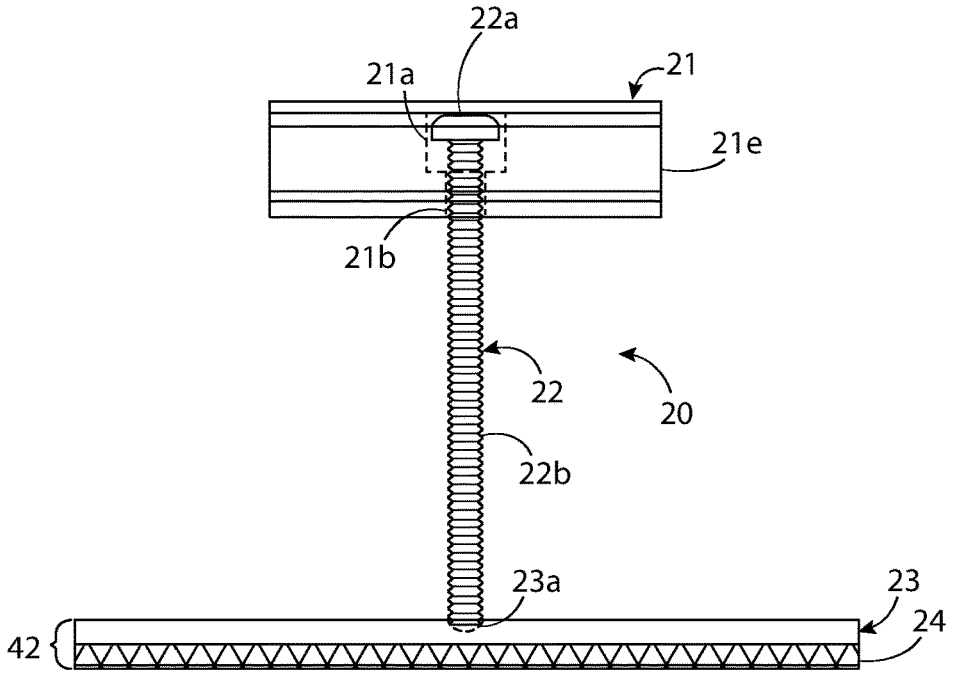
FIG. 35 illustrates in front view, the fourth alternative example of the setting block adjustment device of FIG. 34.
Figure 36:
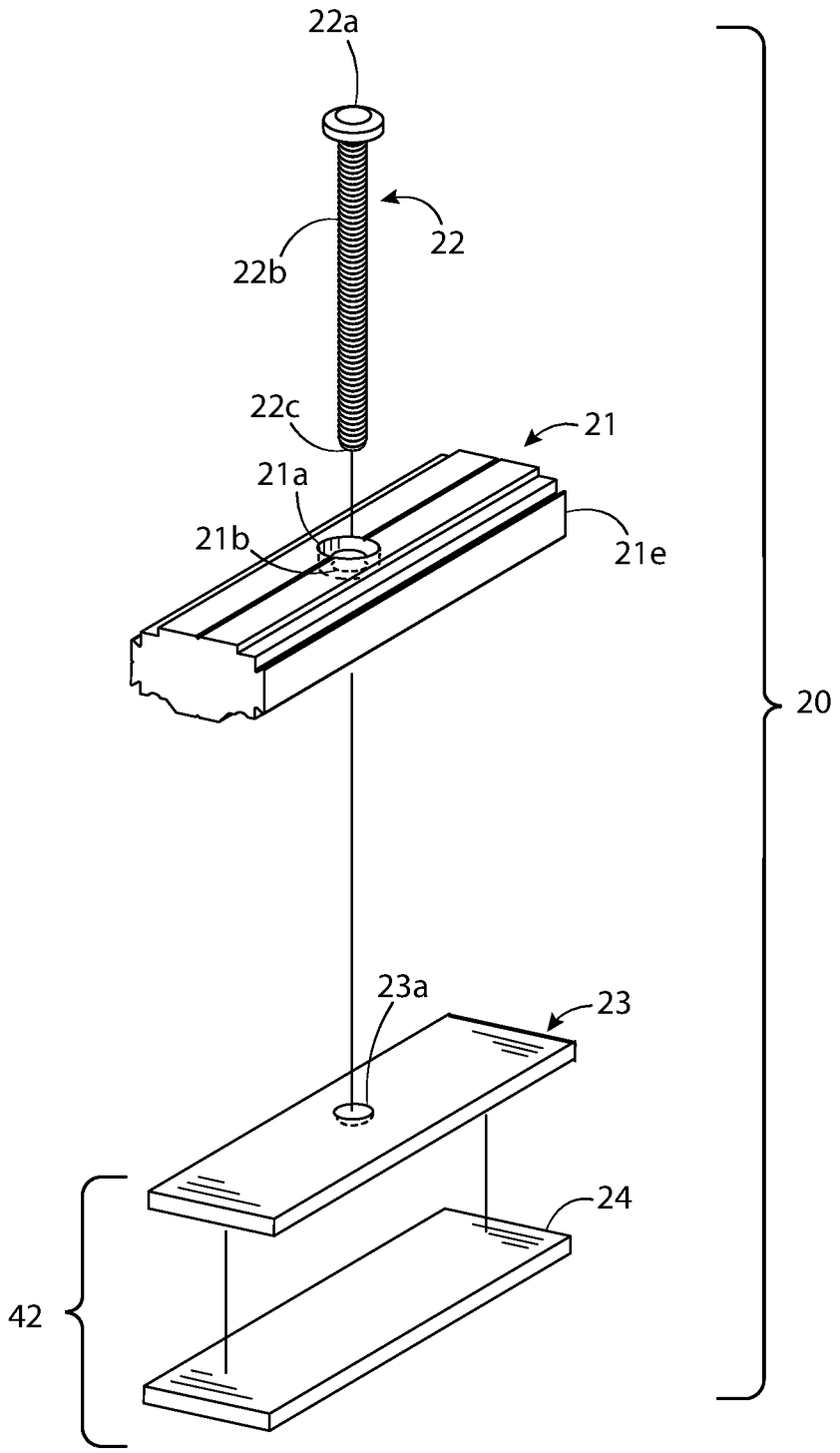
FIG. 36 illustrates an exploded isometric view, of the fourth alternative example of the setting block adjustment device of FIG. 34.

The lug 21 in FIGS. 22-33 are shaped to be slidably captive within the groove 31*d* positioned lengthwise along the outer face 31*e* of the operable fenestration frame 31 of FIGS. 8-14 and FIGS. 17-21. The outer face 31*e* lies along the outside perimeter surface of the operable fenestration frame 31. In these examples, the groove 31*d* is an American-style Euro-groove and aligned over the infill panel 32. The lug 21 is approximately complementary shaped to the groove 31*d*. Referring to FIGS. 21-33 and FIGS. 37-39. the lug 21 includes a rectangular inset 21*c* along the side surfaces 21*d*. The side surfaces 21*d* extend perpendicularly from bottom surface of the lug 21. The inventor envisions that the shape of the lug 21 can be modified to be slidably captive in variety of grooves shapes. For example, the groove 31*d* depicted in FIGS. 15 and 16 differs greatly from the groove 31*d* of FIGS. 8-14 and FIGS. 17-21. Referring to FIGS. 34-36, the lug 21 include a pair of flanged projections 21*e* extending from the side surfaces 21*d* of the lug 21. Referring to FIGS. 15 and 16, the shape of the lug 21 engages corresponding complementary shapes in the side surfaces of the groove 31*d* causing the lug to be slidably captive. The inventor envisions that any lug 21 combined with a groove 31*d* lengthwise along the outer face 31*e* that is slidably captive is within the scope of the setting block adjustment device 20. The lug 21 can be extruded, molded, cast or otherwise formed. The lug 21 can be made of any material capable of withstanding the forces encountered in the day-to-day operation of the operable fenestration combined with an infill panel 32. For example, the lug can be made of aluminum, steel, polymer, or thermal plastic but is not limited to these materials.

Figure 37:
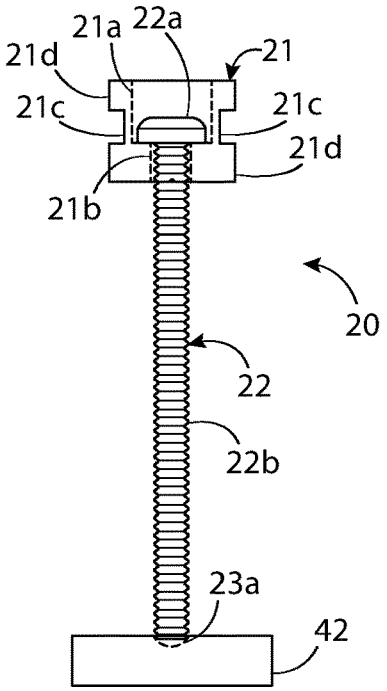
FIG. 37 illustrates, illustrates, in side view, a fifth alternative example of the setting block adjustment device.
Figure 38:
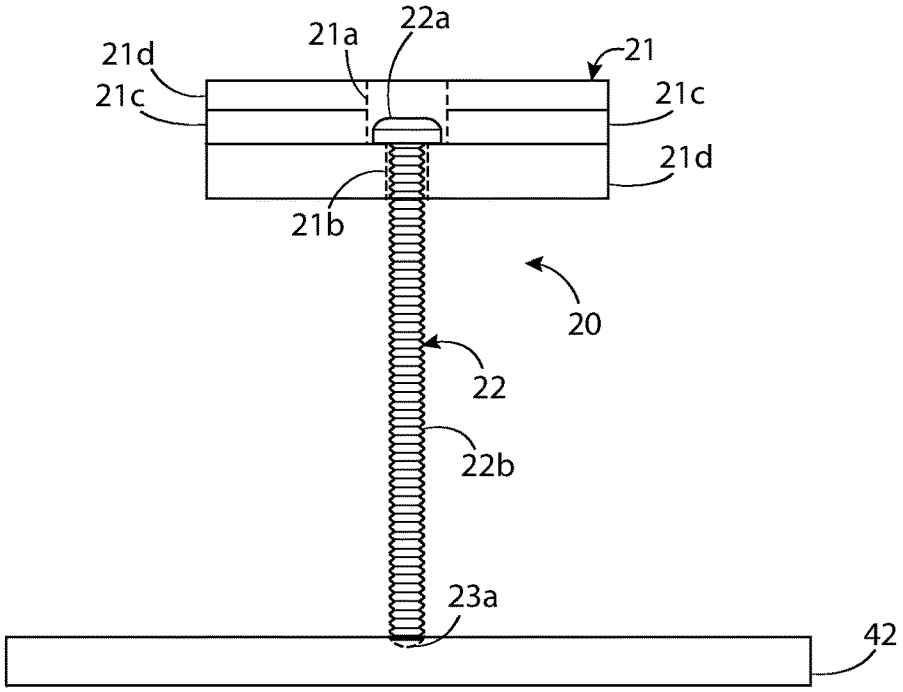
FIG. 38 illustrates, in front view, the fifth alternative example of the setting block adjustment device of FIG. 37.

Referring to FIGS. 23-36, the setting block support plate 23 and setting block 24 together form a setting block assembly 42. The setting block support plate 23 and setting block can be secured to each other, for example by adhesive, adhesive tape, or sealant such as silicon or urethane sealant, or left unsecured. The setting block is typically made of a material with elastic properties such as EPDM, neoprene, rubber, silicone, or other flexible materials suitable for supporting the weight of the infill panel and cushioning it from breakage when secured against the operable fenestration frame. The setting block support plate 23 is typically made of steel, aluminum, polymer, plastic or other material strong enough to withstand the forces of the threaded fastener and infill panel during typical operation of the operable fenestration. Referring to FIGS. 37-39, the setting block assembly 42 can be a single integral unit. In one example, the setting block assembly 42 can combine the cushioning properties of the setting block 24 and the strength of the setting block support plate 23 of FIGS. 23-36. Typically, this can be formed from a polymer or plastic with properties capable of cushioning the infill panel and strength to withstand the forces from the frame and infill panel during operation of the operable fenestration. If the infill panel 32 of FIGS. 4-21, 41, and 42 is made of a material that does not need cushioning, for example, aluminum, wood, or foam filled aluminum panels, the setting block assembly 42 need not have the cushioning properties of setting block 24. In that case, the setting block assembly in FIGS. 37-39 can optionally be made of a non-cushioning material, for example, aluminum, steel, wood, hard polymer, or hard plastic.

FIGS. 40 and 41 show the setting block adjustment devices 20 in relation to various components of the operable fenestration 30 that is hung from the top. In FIG. 40, the operable fenestration is hinged from the top. For example, the configuration of FIG. 40 could represent a hinged window. In FIG. 41, the operable fenestration is slidably suspended from a frame 39 along the top, for example in a sliding door or sliding window, hung by trolleys or by helical bearings 43 as illustrated. The helical bearings 43 are shown as broken lines to indicate they are hidden from view within the frame 39. Referring to FIGS. 40 and 41 the operable fenestration 30 includes an operable fenestration frame 31, an infill panel 32, and glazing stops 33. The perimeter edge 32*a* of the infill panel 32 is shown in dashed lines to indicate it is hidden beneath the glazing stops 33. The difference in the usage of the setting block adjustment device from the examples in FIGS. 4-6 is simply the usage. In FIGS. 40 and 41, setting block adjustment devices 20 are placed near the lower right vertical edge and the upper left vertical edge of the operable fenestration frame 31. Setting blocks 34 are placed near the upper left horizontal edge and lower right horizontal edge. The combination of the setting blocks 34 and setting block adjustment devices 20 in the above described configuration allows for adjustment for variances the angles between the operable fenestration frame members from either assembly or settling. As with FIGS. 4-6, while FIGS. 40 and 41 show butt joint frames, the setting block adjustment device 20 can work with hung windows or doors or horizontally hinged fenestrations with both mitered corner joints and butt corner joints.

A setting block adjustment device 20 combined with operable fenestrations that includes a groove 31*d* for captively and slidably engaging the lug 21 within the setting block adjustment device 20 has been described. This disclosure does not intend to limit the claimed invention to the examples and variations described in the specification. Those skilled in the art will recognize that variations will occur when embodying the claimed invention in specific implementations and environments. For example, the disclosure illustrates two examples of lugs 21, however, the inventor envisions that any lug 21 slidably captive within the groove 31*d* can fall within the scope of the inventive concept. For example, the lug 21 and groove 31*d* could be rectangular with the groove having a planar overhang on the outer most surface to keep the lug 21 slidably captive.

It is possible to implement certain features described in separate embodiments in combination within a single embodiment. Similarly, it is possible to implement certain features described in single embodiments either separately or in combination in multiple embodiments. For example, the projected portion 23*c* of the setting block support plate 23 of FIGS. 25-27 or the toothed projection of FIGS. 28-30 can be implemented with the setting block adjustment device 20 of FIGS. 34-36. Similarly, the lug 21 of FIGS. 34-36 with the groove 31*d* of FIGS. 15 and 16 can be implemented in the operable fenestrations of FIGS. 13 and 14, 17-20. The inventor envisions these variations fall within the scope of the claimed invention.

While the examples, exemplary embodiments, and variations are helpful to those skilled in the art in understanding the claimed invention, the scope of the claimed invention is defined solely by the claims and their equivalents.

What is claimed is:

1. A system for adjusting an infill panel of an operable fenestration, comprising:

an operable fenestration frame including an outer face extending longitudinally along an outside perimeter surface of the operable fenestration and parallel to a perimeter edge of the infill panel, an inner face extending longitudinally along an inside perimeter surface of the operable fenestration and parallel to the outside perimeter surface, and a groove extending longitudinally along the outer face;

a setting block adjustment device including a lug, a threaded fastener, and a setting block assembly;

the lug being longitudinally slidably captive within the groove, the lug includes a threaded aperture extending through the lug;

the setting block assembly positioned against the perimeter edge of the infill panel; and the threaded fastener threadedly engages the threaded aperture, extends through the inner face, and non-threadedly engaging the setting block assembly in moving the infill panel relative to the inner face.

2. The system of claim 1, wherein:

the setting block assembly includes a setting block support plate, and a setting block;

the setting block support plate positioned against the setting block and the setting block positioned against the perimeter edge of the infill panel; and the threaded fastener non-threadedly engages the setting block support plate to move the infill panel relative to the inner face.

3. The system of claim 2, wherein:

the threaded fastener non-threadedly engages a detent in the setting block support plate.

4. The system of claim 2, wherein:

the threaded fastener non-threadedly engages a blind hole in the setting block support plate.

5. The system of claim 1, wherein the groove and the lug are aligned longitudinally over the infill panel.

6. The system of claim 1, wherein the groove and the lug are complementary shaped.

7. The system of claim 1, wherein:

the threaded fastener non-threadedly engages a detent in the setting block assembly.

8. The system of claim 1, wherein:

the threaded fastener non-threadedly engages a blind hole in the setting block assembly.

9. The system of claim 1, further comprising:

the lug includes a blind hole and the threaded aperture extending through the lug from a bottom surface of the blind hole;

the threaded fastener includes a head and a threaded body; and the head positioned within the blind hole, the threaded body threadedly engages the threaded aperture.

10. The system of claim 9, wherein:

the setting block assembly includes a setting block support plate, and a setting block;

the setting block support plate positioned against the setting block and the setting block positioned against the perimeter edge of the infill panel; and the threaded fastener non-threadedly engages the setting block support plate to move the infill panel relative to the inner face.

11. The system of claim 10, wherein:

the threaded fastener non-threadedly engages a detent in the setting block support plate.

12. The system of claim 10, wherein:

the blind hole is a first blind hole;

the setting block support plate includes a second blind hole; and the threaded fastener non-threadedly engages the second blind hole.

13. The system of claim 9, wherein the groove and the lug are aligned longitudinally over the infill panel.

14. The system of claim 9, wherein the groove and the lug are complementary shaped.

15. The system of claim 9, wherein:

the threaded fastener non-threadedly engages a detent in the setting block assembly.

16. The system of claim 9, wherein:

the blind hole is a first blind hole;

the setting block assembly includes a second blind hole; and the threaded fastener non-threadedly engages the second blind hole.

17. A system for adjusting an infill panel of an operable fenestration, comprising:

an operable fenestration frame;

a setting block adjustment device including a lug, a threaded fastener, and a setting block assembly;

the lug being slidably captive within the operable fenestration frame, the lug includes a threaded aperture extending through the lug;

the setting block assembly positioned against a perimeter edge of the infill panel; and the operable fenestration frame includes a thermal strut, a first fenestration frame sub-member, and a second fenestration frame sub-member;

the first fenestration frame sub-member and the second fenestration frame sub-member is joined to the thermal strut; and the threaded fastener threadedly engages the threaded aperture, non-threadedly engages the thermal strut, and non-threadedly engaging the setting block assembly in moving the infill panel relative to the operable fenestration frame.

18. The system of claim 17, wherein:

the lug includes a blind hole and the threaded aperture extending through the lug from a bottom surface of the blind hole.

19. A system for adjusting an infill panel of an operable fenestration, comprising:

an operable fenestration frame including an outer face extending longitudinally along an outside perimeter surface of the operable fenestration, an inner face extending longitudinally along an inside perimeter surface of the operable fenestration, and a groove extending longitudinally along the outer face;

a setting block adjustment device including a lug, a threaded fastener, and a setting block assembly;

the lug being slidably captive within the groove, the lug includes a threaded aperture extending through the lug;

the setting block assembly positioned against a perimeter edge of the infill panel; and the threaded fastener threadedly engages the threaded aperture, extends through the inner face, and non-threadedly engaging the setting block assembly in moving the infill panel relative to the inner face;

the operable fenestration frame includes a first thermal strut, a second thermal strut, a first fenestration frame sub-member, and a second fenestration frame sub-member;

the first fenestration frame sub-member and the second fenestration frame sub-member is joined to the first thermal strut located proximate to the outer face and joined to the second thermal strut located proximate to the inner face; and the threaded fastener non-threadedly engages the first thermal strut and the second thermal strut.

20. The system of claim 19, wherein:

the lug includes a blind hole and the threaded aperture extending through the lug from a bottom surface of the blind hole; the setting block assembly positioned against the perimeter edge of the infill panel;

the threaded fastener includes a head and a threaded body; and the head positioned within the blind hole, the threaded body threadedly engages the threaded aperture, extends through the inner face, and non-threadedly engaging the setting block assembly in moving the infill panel relative to the inner face.

* * * * *